US007891754B2

(12) United States Patent
Nagamura et al.

(10) Patent No.: US 7,891,754 B2
(45) Date of Patent: Feb. 22, 2011

(54) PRINTING APPARATUS AND PRINTING METHOD

(75) Inventors: Mitsutoshi Nagamura, Tokyo (JP); Daigoro Kanematsu, Yokohama (JP); Rie Takekoshi, Kawasaki (JP); Naoko Baba, kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 718 days.

(21) Appl. No.: 11/771,530

(22) Filed: Jun. 29, 2007

(65) Prior Publication Data

US 2007/0285457 A1 Dec. 13, 2007

Related U.S. Application Data

(62) Division of application No. 11/003,531, filed on Dec. 6, 2004, now Pat. No. 7,281,780.

(30) Foreign Application Priority Data

Dec. 9, 2003 (JP) ..... 2003-411058
Dec. 22, 2003 (JP) ..... 2003-424984

(51) Int. Cl.
*B41J 29/393* (2006.01)
*B41J 29/38* (2006.01)

(52) U.S. Cl. ..... 347/19; 347/9; 347/14

(58) Field of Classification Search ..... 347/9, 347/14, 19

See application file for complete search history.

(56) References Cited

U.S. PATENT DOCUMENTS 6,089,693 A 7/2000 Drake et al. ..... 347/19
6,283,572 B1 9/2001 Kumar et al.
6,332,662 B1 12/2001 Choi ..... 347/19
6,347,855 B1 2/2002 Takanaka
6,390,583 B1 5/2002 Kato et al.
6,659,580 B2 12/2003 Horikoshi
6,733,100 B1 5/2004 Fujita et al.
2002/0089566 A1 7/2002 Lopez et al. ..... 347/43
2004/0119766 A1* 6/2004 Shibata et al. ..... 347/12
2005/0122366 A1 6/2005 Nagamura et al.

FOREIGN PATENT DOCUMENTS

| | | |
|---|---|---|
| CN | 1733484 | 2/2006 |
| JP | 61-123545 | 6/1986 |
| JP | 10-258526 | 9/1998 |
| JP | 11-988 | 1/1999 |
| JP | 11-77986 | 3/1999 |
| JP | 2000-94662 | 4/2000 |
| JP | 2001-63008 | 3/2001 |

* cited by examiner

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

The present invention provides a printing method comprising a selecting method of selecting defective print elements to be corrected on the basis of, for example, the positional relationship among the defective print elements in a print head so that if there are a plurality of defective print elements such as non-ejection nozzles, not all pixels otherwise printed by the defective print elements are to be corrected but efficient corrections can be achieved on the basis of correlations with the lifetimes of other normal print elements, as well as a correcting method of making up for print data corresponding to the defective print elements selected, and a printing apparatus using the printing method.

8 Claims, 29 Drawing Sheets

| MEDIA TYPE | NOZZLE SPACING SET VALUE |
|---|---|
| A (ORDINARY PAPER) | 30 |
| B (COATED PAPER) | 45 |
| C (GLOSSY PAPER) | 50 |
| D (OHP) | 20 |
| E (POSTCARD) | 25 |
| F (INK JET POSTCARD) | 40 |

FIG.21

| INK TYPE | NOZZLE SPACING SET VALUE |
|---|---|
| BLACK | 50 |
| CYAN | 30 |
| MAGENTA | 25 |
| YELLOW | 10 |

FIG.22

| EJECTION AMOUNT | NOZZLE SPACING SET VALUE |
|---|---|
| 30 pl | 50 |
| 8 pl | 30 |
| 4 pl | 25 |

FIG.23

| PASS NUMBER | NOZZLE SPACING SET VALUE |
|---|---|
| 1 | 50 |
| 2 | 30 |
| 4 | 20 |
| 8 | 15 |
| 16 | 10 |

FIG.24

| PRINT MODE | NOZZLE SPACING SET VALUE |
|---|---|
| A | 30 |
| B | 45 |
| C | 50 |
| D | 20 |
| E | 25 |
| F | 40 |

FIG.27

| PRINT MODE | CORRECTION TARGET NOZZLE NUMBER |
|---|---|
| A | 100, 150, 320, 400 |
| B | 100, 115, 150, 320, 400, 480 |
| C | 100, 115, 150, 320, 400, 480 |
| D | 100, 400 |
| E | 100, 150, 320, 400 |
| F | 100, 115, 150, 345, 400, 480 |

FIG.28

| PRINT MODE | NOZZLE SPACING SET VALUE |
|---|---|
| A | 0 |
| B | 0 |
| C | 0 |
| D | 0 |
| E | 0 |
| F | 0 |

CORRECTION LEVEL 1

FIG.33A

| PRINT MODE | NOZZLE SPACING SET VALUE |
|---|---|
| A | 20 |
| B | 35 |
| C | 40 |
| D | 10 |
| E | 15 |
| F | 30 |

CORRECTION LEVEL 2

FIG.33B

| PRINT MODE | NOZZLE SPACING SET VALUE |
|---|---|
| A | 30 |
| B | 45 |
| C | 50 |
| D | 20 |
| E | 25 |
| F | 40 |

CORRECTION LEVEL 3

FIG.33C

| PRINT MODE | NOZZLE SPACING SET VALUE |
|---|---|
| A | 40 |
| B | 55 |
| C | 60 |
| D | 30 |
| E | 35 |
| F | 50 |

CORRECTION LEVEL 4

FIG.33D

| PRINT MODE | NOZZLE SPACING SET VALUE |
|---|---|
| A | 1280 |
| B | 1280 |
| C | 1280 |
| D | 1280 |
| E | 1280 |
| F | 1280 |

CORRECTION LEVEL 5

FIG.33E

PRINTING APPARATUS AND PRINTING METHOD

This application is a division of U.S. patent application Ser. No. 11/003,531, filed Dec. 6, 2004.

BACKGROUND OF THE INVENTION

1. Field of the Invention

The present invention relates to a printing apparatus and a printing method which performs printing images on print media by using a print head composed of a plurality of print elements, and more specifically, to a printing method for printing so as to complement printing of a printing area to be otherwise printed by the defective print element by using another normal print element, if any of a plurality of print elements becomes defective, as well as a printing apparatus using the printing method.

2. Description of the Related Art

Proposed printing apparatuses that print images on a printing medium such as a sheet of paper or OHP sheets are provided with print heads based on various printing method. The printing method of the print head includes a wire-dot type, a thermal type, a heat transfer type, or an ink-jet type. In particular, the ink jet type receives attention. This is because this method ejects ink directly on a printing surface of print paper and thus is provided at low running costs and enables to print quietly.

Some of the printing apparatuses are of a carriage scanning type in which a carriage provided with a print head is made to move in a horizontal direction substantially parallel to a printing surface of print paper. In such an ink jet printer of the carriage scanning type, after the print head performs printing on one scan printing area of a printing medium by actuating a large number of nozzles provided in the print head on the basis of print information, while scanning the carriage, the printing medium is fed by a distance corresponding to the one scan printing area in a direction perpendicular to a direction in which the carriage progresses. Consequently, the scan and the conveyance of the print medium are alternately repeated in such a manner to perform printing, thus a predetermined image is formed on the printing surface of the print medium.

A large number of nozzles (ejection openings) for ejecting ink droplets are formed in the print head. Ink used to print images on print media is filled in the nozzles. When an image is printed, nozzles corresponding to image data are appropriately selected among nozzles and printing is performed by ejecting ink droplets from these nozzles.

In ink jet printing apparatuses, in recent years, it is to be desired that printing with an increasingly higher quality and resolution can be realized. As means for realizing this request, finer nozzles are used to form images. On the other hand, fine nozzles having a relatively small ejection opening diameter tend to provide ejection failure easily as compared with conventional nozzles having a large ejection opening diameter. For example, dust or ink with an increased viscosity may adhere to the vicinity of the ejection openings to change the amount of ink ejected. In a severe case, the ink may not be ejected.

Further, in a bubble jet (trade mark) type in which electrothermal converters (heaters) are used to generate bubbles in ink to eject the ink from fine nozzles densely arranged, there is a possibility that any of the heaters are disconnected to preclude the ejection of the ink or ink droplets adhere to an ejection opening surface to cover the ejection openings, resulting in precluding the ejection of the ink.

Therefore, printing unstable that come from the ejection failure of the nozzles may be provided, resulting in degrading print images.

In particular, in a serial type-based printer, printing is carried out by scanning the print head. The presence of a nozzle from which ink cannot be ejected may result in forming lines which are not printed along a scan direction in print images. As a result, white lines appear in a print image. The white lines are a contributing factor significantly degrading the print image.

Owing to this problem, if the number of nozzles is increased to several hundreds or thousands in order to improve a print throughput, the probability of occurrence of abnormal nozzles such as non-ejection nozzles which the ink cannot be ejected from the nozzle increases proportionately. Accordingly, it is difficult to obtain defect-free images A large number of methods as a remedy have been proposed to deal with this situation; these methods include one for detecting various defective print elements and a method for recovering the print head or carrying out printing, on the basis of the results of the detection.

Japanese Patent Application Laid-open No. 61-123545 (1986) discloses a method for printing by using a normal channel to print based on image data for a defective channel in a printing apparatus that carries out one pass printing in which the same image area is printed during one print scan. Also, the above official gazette discloses method for correcting defective channel portion by the normal channel after the paper is fed by a distance corresponding to an integral multiple of one pixel in order to alternative printing such that when the carriage is made to move rightward for printing, normal printing is carried out, on the one hand, when the carriage is made to move leftward, pixels that cannot be printed owing to defective print elements are printed by using other normal print elements.

Japanese Patent Application Laid-open No. 11-077986 (1999) discloses a method for sequentially switching the correction nozzles in consideration of the lifetimes of the correction nozzles for corrective printing, the method in which the frequency of using the correction nozzles is counted and the correction nozzles are switched if the total use frequency counted reaches a predetermined value. With this method, if the alternative printing is carried out in a manner similar to invention disclosed in Japanese Patent Application Laid-open No. 61-123545 (1986), 2-pass printing is substantially performed.

Japanese Patent Application Laid-open No. 11-000988 (1999) discloses a method of controlling printing using a print head having n print elements. With this method, n/m (m is a divisor of the number of nozzles) print elements are set as first print elements used for normal print scans. Further, other n(m−1)/m print elements are set as second print elements not used for normal print scans. Thus, the second print elements are used as alternatives for a printing operation only if any of the first print elements is defective. A precondition in this case is multipass printing in which an image is basically completed in the same image area in m print scanning and paper feeding operations.

Japanese Patent Application Laid-open No. 10-258526 (1998) discloses a method for completely replacing missing data corresponding to one nozzle with data of another nozzle. With this method, an alternative replacing nozzle is then selected in accordance with the position of the defective nozzle identified after a standard print mask is obtained before printing. Subsequently, print data is deleted from mask data corresponding to the defective nozzle and print data deleted then is added to mask data corresponding to the replacement nozzle. This proposal is premised on the multipass printing as in the case of the method disclosed in Japanese Patent Application Laid-open No. 11-000988 (1999).

In Japanese Patent Application Laid-open No. 2000-094662, a proposed method is method for correcting print data of the non-ejection nozzles by using the other N−1 nozzles, even if ink cannot be ejected from one or more of the N nozzles, though in the case of multipass printing a printing per one raster in N pass is completed by using N nozzles during N print scans. That is, it is considered that pixels to be printed by the non-ejection nozzles are complemented by the other normal nozzles so as to prevent pixels to be printed by the non-ejection nozzles from resulting in blank dots.

Japanese Patent Application Laid-open No. 2001-063008 discloses a method of making corrections using a print element placed in parallel with a defective print element in the print scan direction. Specifically, that discloses method for correcting a defective print element produced in a print head from which a black ink is ejected by a print element in a print head from which a cyan, magenta, and yellow inks are ejected, placed in parallel with the black print head.

The above correction methods can be used to improve the degradation of images caused by non-ejection.

However, if corrective printing is carried out using normal nozzles in place of non-ejection nozzles as described above, the endurance lifetimes of the nozzles used for the correction are reduced by a value corresponding to at least the number of times the nozzles have been used for the correction. The lifetimes of nozzles more frequently used for the correction are over earlier in comparison with those of nozzles not used for the correction. Consequently, the nozzles frequently used for the correction may prematurely cause ejection mis-alignment in which an impacting position prematurely deviates from the regular one, irregular ejection in which an amount of ejection varies, or non-ejection.

That is, in view of preventing the degradation of images caused by non-ejection nozzles, it is necessary to correct the defective part by using normal nozzles. However, in view of the lifetimes of normal nozzles used for the correction, every effort should be made to avoid the corrective printing.

Further, visibility of a missing part of an image formed by a non-ejection nozzle varies depending on the position and amount of the missing part. For example, even if a white line corresponding to one nozzle occurs in only one area of the entire image formed, this missing part is not so noticeable. In particular, if the image is formed of small-diameter dots from fine nozzles, the missing part is not substantially noticeable. On the other hand, if two or three white lines are intensively in a relatively narrow image area, they appear as one thick white line, seen from a distance; they may be thus noticeable.

However, since these image missing parts have been uniformly corrected in the past, even parts that are otherwise unperceived as the degradation of image even without corrections are corrected. Consequently, there is a possibility that the lifetimes of normal nozzles wastefully shrink.

This problem also applies not only to ink jet printing apparatuses but also to other printing apparatuses that carry out printing using a plurality of print elements. The finer one print area printed by each print element is, the less noticeable a missing part corresponding to a defective print element is in the entire image if there is only one missing part. On the other hand, in the area intensively having a plurality of missing parts, these missing parts of printing are noticeable, thus missing parts of printing significantly affect the quality of the entire image.

SUMMARY OF THE INVENTION

The present invention provides a printing method comprising a selecting method of selecting defective print elements to be corrected on the basis of, for example, the positional relationship among the defective print elements in a print head so that if there are a plurality of defective print elements such as non-ejection nozzles, not all pixels otherwise printed by the defective print elements are to be corrected but efficient corrections can be achieved on the basis of correlations with the lifetimes of other normal print elements, as well as a correcting method of making up for print data corresponding to the defective print elements selected, and a printing apparatus using the printing method.

To accomplish the above object, a printing apparatus according to the present invention provides a printing apparatus that uses a print head having a plurality of print elements to print a print medium, characterized by comprising calculating means for, when the plurality of print elements include a plurality of defective print elements, calculating a distance between the defective print elements on the basis of a relative positional relationship among the plurality of defective print elements, comparing means for comparing the distance between the defective print elements calculated by the calculating means with a preset value, selecting means for selecting, as correction targets, defective print elements for which the comparing means has determined that the distance between the elements is no more than the set value, correction data creating means for correcting print data such that normal print elements print areas otherwise printed by the defective print elements selected by the selecting means, and printing means for carrying out printing on the basis of the correction data created by the correction data creating means.

The present invention also provides a printing method of using a print head having a plurality of print elements to print a print medium, the method comprising a calculating step of, when the plurality of print elements include a plurality of defective print elements, calculating a distance between the defective print elements on the basis of a relative positional relationship among the plurality of defective print elements, a comparing step of comparing the distance between the defective print elements calculated in the calculating step with a preset value, a selecting step of selecting, as correction targets, the defective print elements for which it has been determined in the comparing step that the distance between the elements is no more than the set value, a correction data creating step of correcting print data such that normal print elements print on print areas otherwise printed by the defective print elements selected in the selecting step, and a printing step of carrying out printing on the basis of the correction data created in the correction data creating step.

With the above configuration, when there are a plurality of defective print elements, not all the pixels otherwise printed by the plurality of defective print elements are to be corrected. However, defective print elements to be corrected are selected on the basis of the positional relationship among the defective print elements in a print head as well as various conditions for print media and ink. Then, other normal print elements are used to print only the pixels otherwise printed by the defective print elements selected. This makes it possible to achieve high-quality printing without wastefully reducing the lifetimes of normal print elements or minimizing the loss of durability of the print head.

The above and other objects, effects, features and advantages of the present invention will become more apparent from the following description of embodiments thereof taken in conjunction with the accompanying drawings.

BRIEF DESCRIPTION OF THE DRAWINGS

FIG. 21 is a table showing the relationship between the type of print media and a set value for the nozzle spacing;

FIG. 22 is a table showing the relationship between the type of ink and the set value for the nozzle spacing;

FIG. 23 is a table showing the relationship between the amount of ink ejected and the set value for the nozzle interval;

FIG. 24 is a table showing the relationship between the number of passes required to form one raster and the set value for the nozzle spacing;

FIG. 27 is a table showing spacing set values for nozzles to be corrected for each print mode;

FIG. 28 is a table showing nozzles to be corrected for each print mode;

FIGS. 33A, 33B, 33C, 33D, and 33E are tables showing set values for the nozzle spacing corresponding to respective correction levels.

DETAILED DESCRIPTION OF PREFERRED EMBODIMENT

According to an embodiment of the present invention, when making up for missing parts corresponding to defective print elements using other normal print elements, a printing apparatus does not execute complementary printing on all the defective print elements. Instead, the printing apparatus selects defective print elements corresponding to a noticeable missing part and executes a correcting process on the defective print elements selected by using normal print elements. Consequently, since the print data on all the defective print elements is not made up for, but the print data on only the defective print elements corresponding to noticeable missing part is made up for, the number of normal print elements used for the correcting process is reduced. Consequently, the degradation of an image formed can be minimized while avoiding a decrease in the lifetimes of the print elements.

In the specification, nozzles (print elements) in which defects are occurring are referred to as non-ejection nozzles; these defective nozzles include those in a non-ejection state through which ink cannot be ejected, or nozzles through which ink droplets can be ejected but with which impacting positions deviate from the correct ones to the degree that image quality is degraded and those which can not maintain uniform amount of ink ejected.

The best embodiment of the present invention will be described below in connection with an ink jet printing apparatus by way of example. However, the present invention is not limited to this but to applicable to any printing apparatus that carries out printing using a plurality of print elements.

The best embodiment of the present invention will be described below with reference to the drawings.

(Summary of Printing Apparatus)

Figure 1:
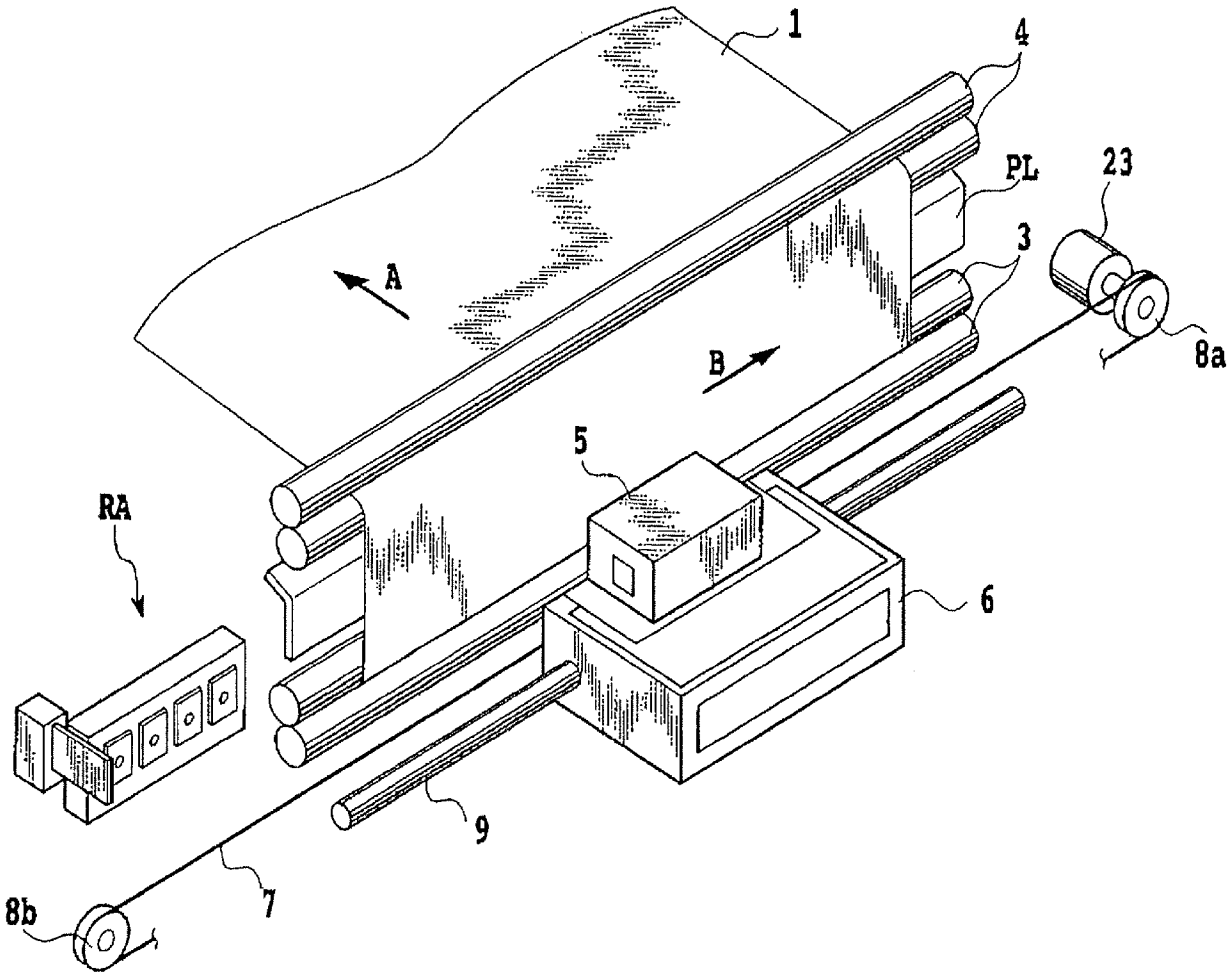
FIG. 1 is a schematic perspective view of a printing section of an ink jet printing apparatus according to an embodiment of the present invention.

FIG. 1 is a schematic perspective view of a printing section of an ink jet printing apparatus according to an embodiment of the present invention.

Reference numeral 1 denotes a print sheet consisting of paper, a plastic sheet, or the like and serving as a print medium. A plurality of print media are stacked and housed in a cassette or the like (not shown). A sheet feeding roller (not shown) which contacts with the uppermost or lowermost one of the stacked print sheets 1 is made to rotate, which feed the print sheets 1 from the cassette one by one. Thus, the print sheet fed is placed over a platen PL so that there is a specified spacing between the sheet and the platen. The print sheet 1 placed over the platen PL is conveyed in the direction of arrow A (hereinafter referred to as a "sub-scanning direction") by a pair of first conveying rollers 3 and a pair of second conveying rollers 4 each driven by a stepping motor (not shown).

Reference numeral 6 denotes a carriage provided so as to reciprocate linearly along a horizontal guide shaft 9 held in a main scanning direction orthogonal to the sub-scanning direction. The carriage 6 is configured to be interlocked with operations of a carriage motor 23 via a belt 7 and pulleys 8*a* and 8*b*. The carriage motor 23 is driven to reciprocate the carriage 6 along the guide shaft 9. A print head 5 is mounted on the carriage 6. The print head 5 is installed so that a nozzle surface consisting of a plurality of nozzles confronts the print sheet 1.

In the printing section configured as described above, the print head 5 ejects ink on a print surface of the print sheet 1 in accordance with a print signal while moving in the direction of arrow B (hereinafter also referred to as a "main scanning direction") together with moving of carriage 6. Thus, the print head 5 carries out printing in one scan print area corresponding to the width of the print head 5 over which the nozzles are disposed in the sub-scanning direction. The print head 5 is returned to a home position as required such that a recovery apparatus RA placed at the home position recovers the nozzles from a clogged state. Further, once the print head 5 has scanned the print sheet 1, the pair of conveying rollers 3 and 4 is driven to convey the print sheet 1 in the direction of the arrow A by a distance corresponding to the one scan print area. In this manner, an image is formed all over the print surface of the print sheet 1 by alternately repeating the print scan of the print head 5 and the conveyance of a predetermined amount of print medium by the conveying rollers 3 and 4.

In the main scanning direction, preliminary ejection receiving members (not shown) are installed across the print sheet 1 to carry out preliminary ejection. Thus, in each scan, preliminary ejection can be carried out both during forward printing and during backward printing.

Figure 2:
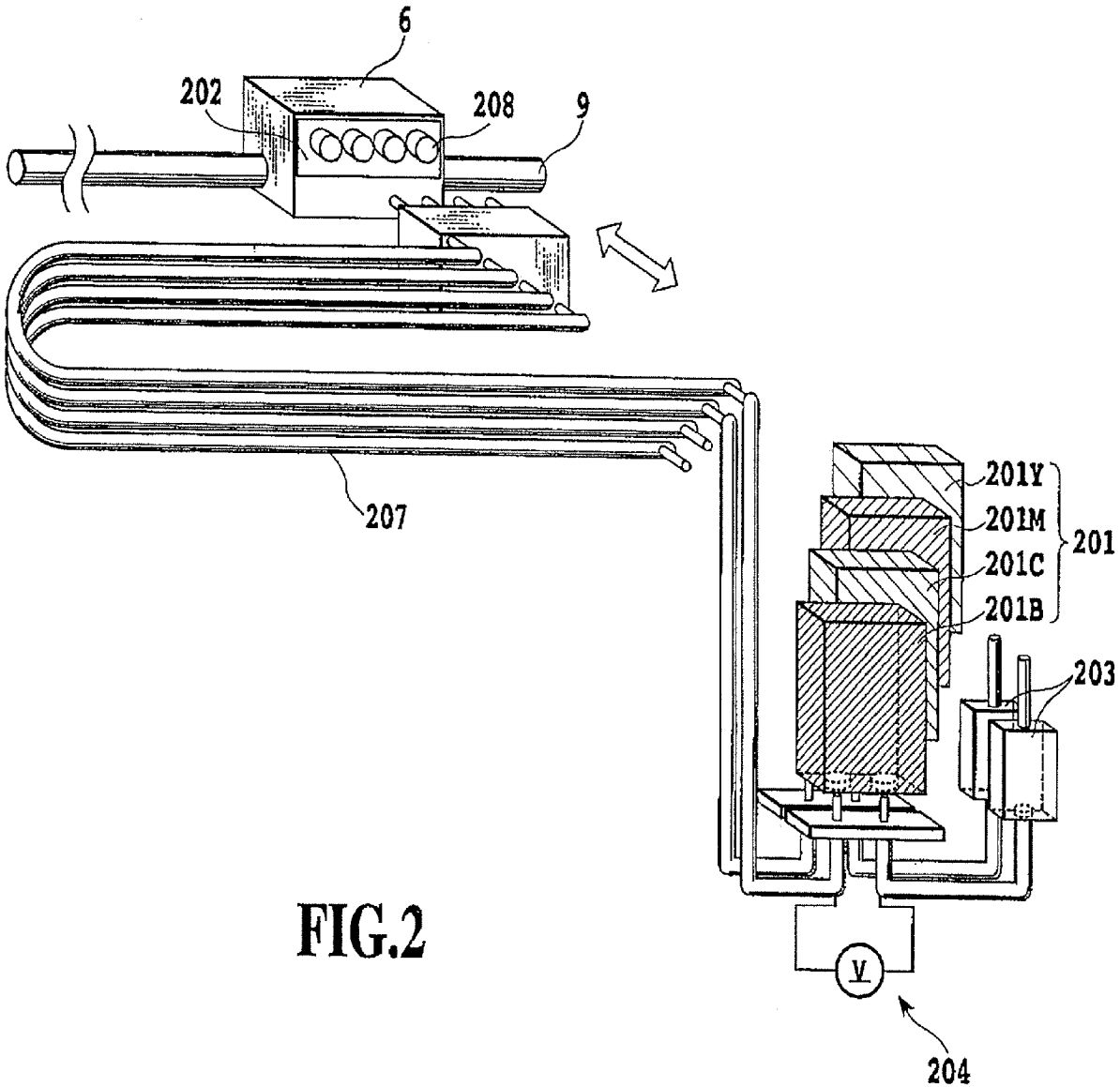
FIG. 2 is a schematic diagram showing an ink supplying section of the ink jet printing apparatus.

FIG. 2 is a schematic diagram showing an ink supplying section of the ink jet printing apparatus.

Ink from a main ink tank 201 is replenished to a sub-ink tank 202 on the carriage 6 via a tube 207 and a joint 208. Ink in an ink tank 202 is supplied to the print head 5. In the main ink tank 201, reference numerals 201Y, 201M, 201C, and 201B denote sections that contain a yellow, magenta, cyan, and black inks, respectively. The print head 5 is moved in the main scanning direction along the guide shaft 9 together with the carriage 6.

In FIG. 2, reference numeral 203 denotes a buffer chamber. Reference numeral 204 denotes a pin type ink remaining amount detecting circuit that detects the amount of ink remaining in the ink containing sections.

The recovery apparatus RA carries out, for example, preliminary ejection in which the print head 5 carries out ink ejection not involved in printing, on a cap portion and a suction process in which the nozzle surface of the print head 5 is capped by the cap portion and then sucked by a suction pump. The recovery apparatus RA also carries out wiping in which when the print head 5 is scanned, the nozzle surface of the print head is scanned over and wiped by a nozzle wiper provided in the recovery apparatus RA.

Figure 3:
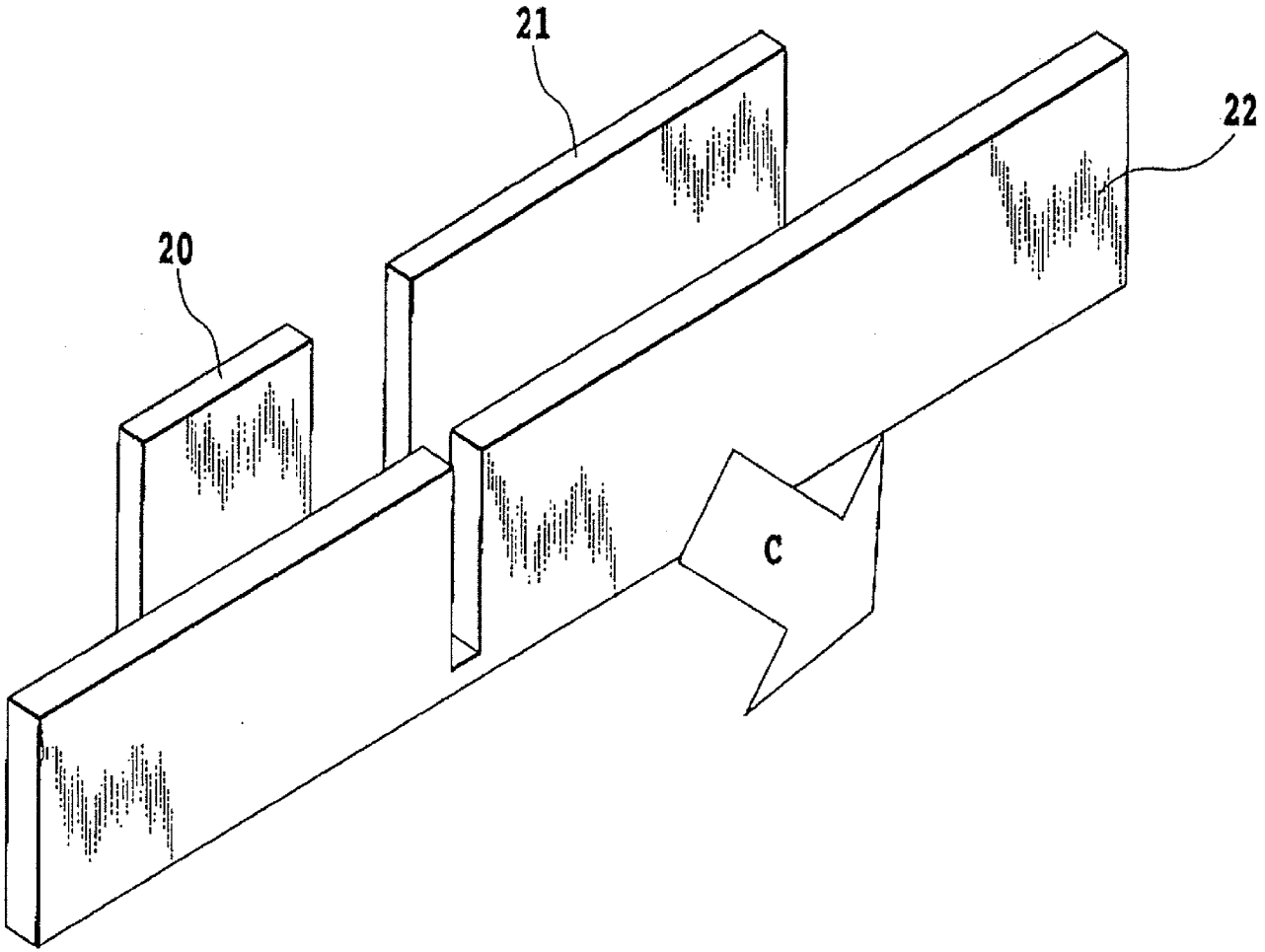
FIG. 3 is a schematic diagram showing a nozzle wiper.

FIG. 3 is a schematic diagram showing a appearance of the wiper of the ink jet printing apparatus.

Figure 4:
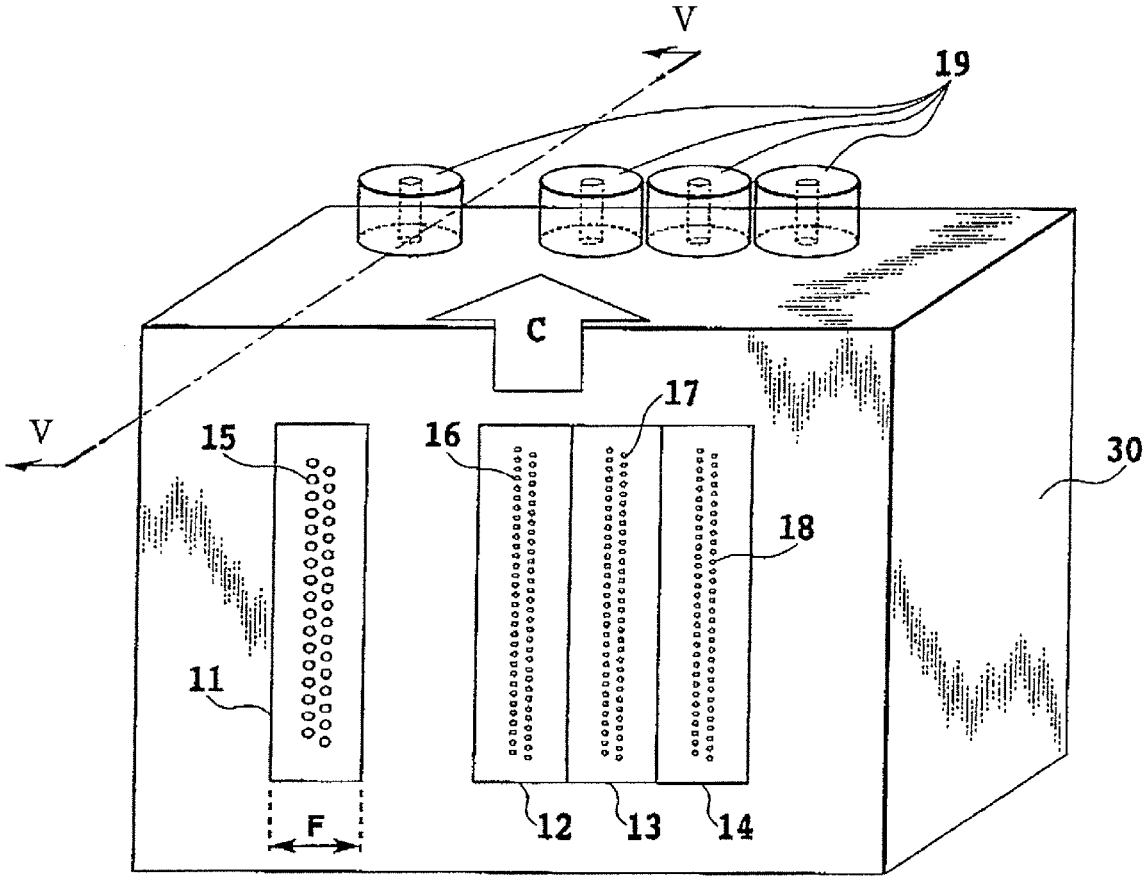
FIG. 4 is a schematic diagram showing a print head.

FIG. 4 is a schematic diagram showing the appearance of the print head 5.

Figure 5:
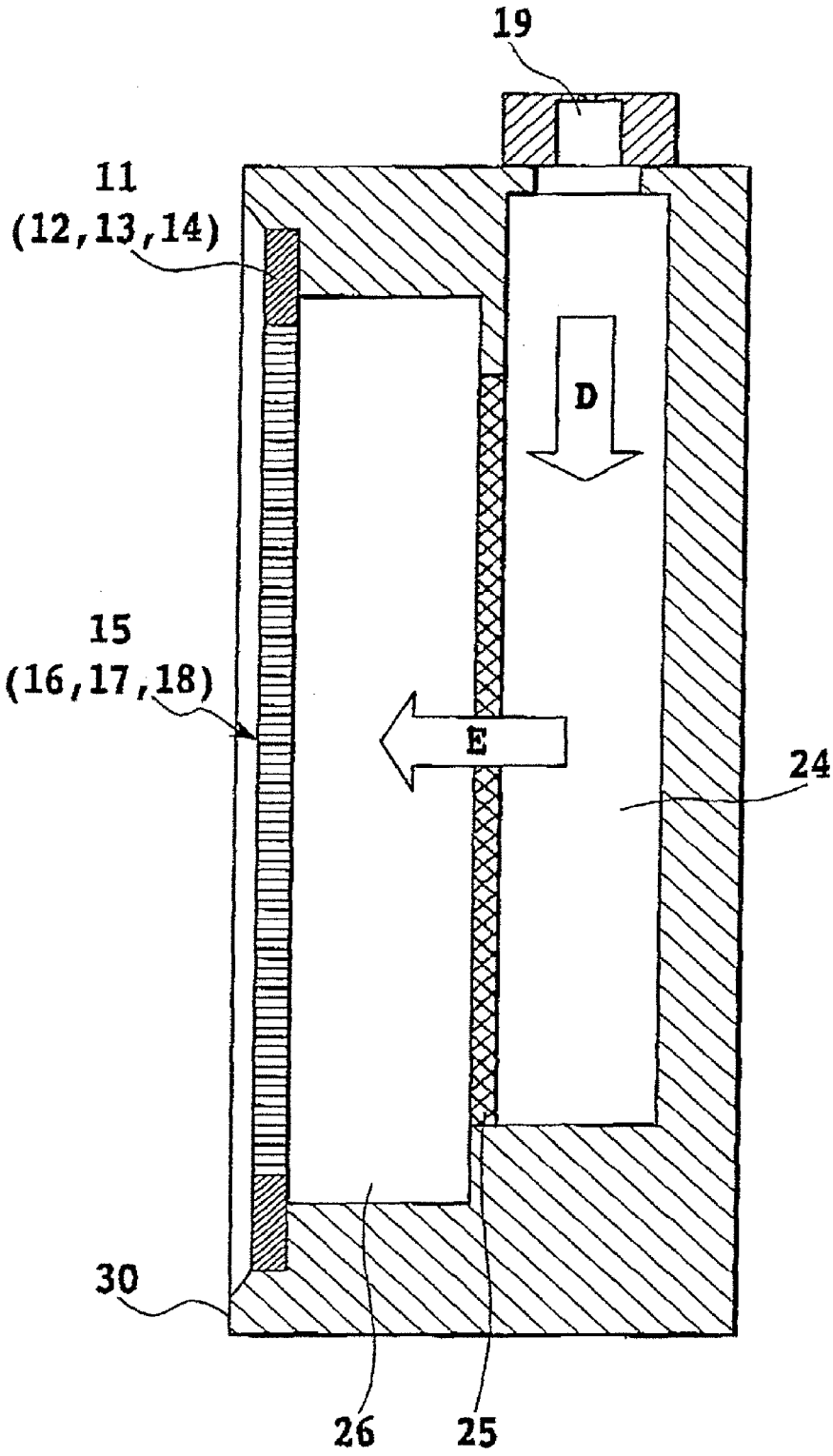
FIG. 5 is a schematic diagram of a cross section taken along line V-V in FIG. 4.

FIG. 5 is a sectional view taken along line V-V in FIG. 4.

In FIG. 4, the print head 5 has, on an ink ejection opening formed surface, plates 11, 12, 13, and 14 from which a black, cyan, magenta, and yellow inks, respectively, are ejected. The plates 12, 13, and 14 are arranged parallel to one another. Further, the plate 11 is separated from the leftmost plate 12.

The width of a nozzle wiper 20 (see FIG. 3) in the recovery apparatus RA which is used to wipe the black ink plate 11 is smaller than width F of the plate 11 (hereinafter referred to as a "chip"), which is shown in FIG. 4 and on which the nozzle surface 15 is formed. As shown in FIG. 5, the nozzle surface 15 on the plate 11, the nozzle surface 16 on the plate 12, the nozzle surface 17 on the plate 13, and the nozzle surface 18 on the plate 14 are arranged so as to sink slightly from a tab surface 30 of the print head 5.

The tip of the nozzle wiper 20 enters the recess portion in which the nozzle surface 15 is provided to wipe the nozzle surface 15. The nozzle surface 15 is recessed from the tab surface 30 in order to avoid contacting with the print sheet 1.

Similarly, in FIG. 3, the width of a color nozzle wiper 21 that simultaneously wipes the nozzle surfaces of the color plates 12, 13, and 14 is no more than the total width of color plates 12, 13, and 14 arranged parallel and adjacent to one another.

Moreover, in FIG. 3, a wiper 22 is provided parallel to the nozzle wiper 20 and color nozzle wiper 21 and has a wiper larger than the total width of the wipers 20 and 21. The wiper 22 is used to wipe the tab surface 30.

The wiper shown in FIG. 3 is attached to a wiper holder (not shown) via a wiper fixture (not shown). The wiper is aligned by fitting pins provided on the wiper holder into holes formed in the wipers 20, 21, and 22.

When a purge motor (not shown) drives the wiper holder, the tips of the wipers 20, 21, and 22 wipe the nozzle surfaces (orifices) 16 to 18 and the tab surface 30 in the direction of arrow C in FIGS. 3 and 4. When a wiping operation is finished, the carriage 6 is moved out of a wiping area in the recovery apparatus RA so as to evacuate. Then, the wiper holder is driven in the opposite direction to return each wiper to a position where it starts wiping.

As shown in FIG. 4, in the black ink plate 11, 640 nozzles are arranged at a density of about 245 per cm. In the color plates 12, 13, and 14, 1280 nozzles are arranged at a density of about 490 per cm.

As shown in FIG. 5, each color ink fed from the main ink tank 201 flows through an ink supply port 19 in the direction of arrow D so as to be guided to an ink liquid chamber 24. The ink liquid chamber 24 is provided upstream of a filter 25 in the print head 5.

Subsequently, each color ink flows in the direction of arrow E so as to be guided to a corresponding ink liquid chamber 26 while the filter 25 filters out dirt and the like from the ink. The ink liquid chamber 26 is provided between the filter 25 and the nozzle surface 15. The ink in the ink liquid chamber 26 is guided to a corresponding nozzle portion for ejecting ink, the nozzle portion formed on a bottom surface of an orifice plate 31 (see FIG. 7) partly constituting the corresponding one of the plates 11 to 14.

Figure 6:
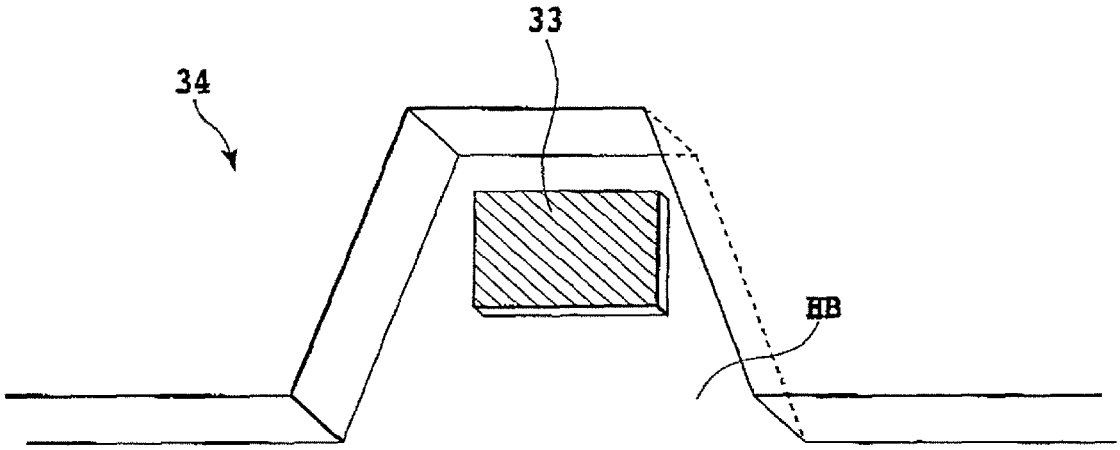
FIG. 6 is a schematic diagram showing a liquid chamber forming member and a heater in the vicinity of an ejection opening in a print head.
Figure 7:
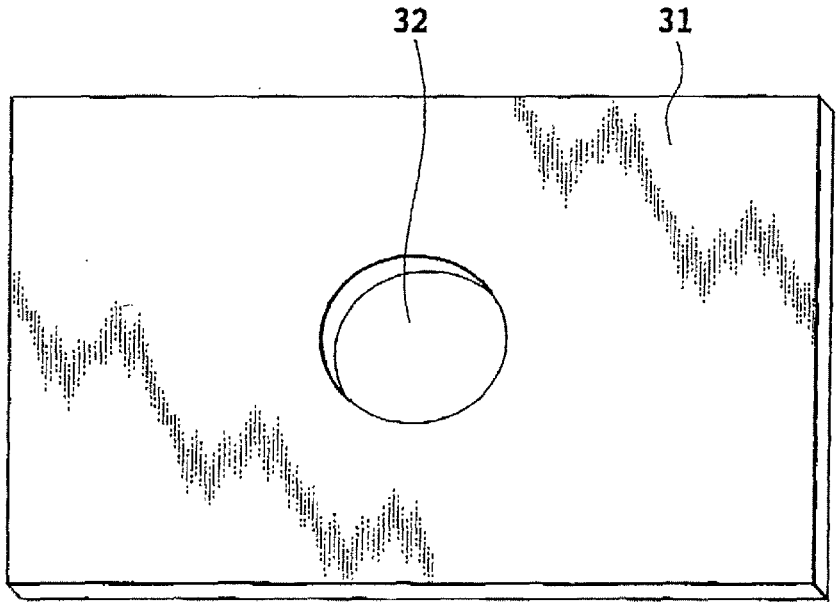
FIG. 7 is a schematic diagram showing an orifice plate and an opening corresponding to a nozzle.

FIGS. 6 and 7 are enlarged views of the periphery of the nozzle portion of the print head 5, shown in FIG. 4. FIGS. 6 and 7 are schematic enlarged views representatively and exaggeratedly show a part corresponding to one ejection opening 32 (hereinafter referred to as a nozzle) in the orifice plate 31. The peripheries of the nozzle portions of the plates 11 to 14 have the same structure.

A downstream part of the ink liquid chamber 26, shown in FIG. 5, is formed of the orifice plate 31 (see FIG. 7), having an ejection opening (nozzle) 32 through which the ink is ejected, a liquid chamber forming member 34, and a heater board HB in which a heater 33 heating ink is mounted. The ink reserved in a part of the liquid chamber forming member 34 which is formed to surround the heater 33 is pushed out of the ejection opening 32 in the orifice plate 31 as bubbles generated by heat from the heater 33 are expanded, which changes the ink to spherical droplets through the interfacial tension between the ink and air and for example, fly and adhere ink droplets on the print surface of the print sheet 1.

Figure 8:
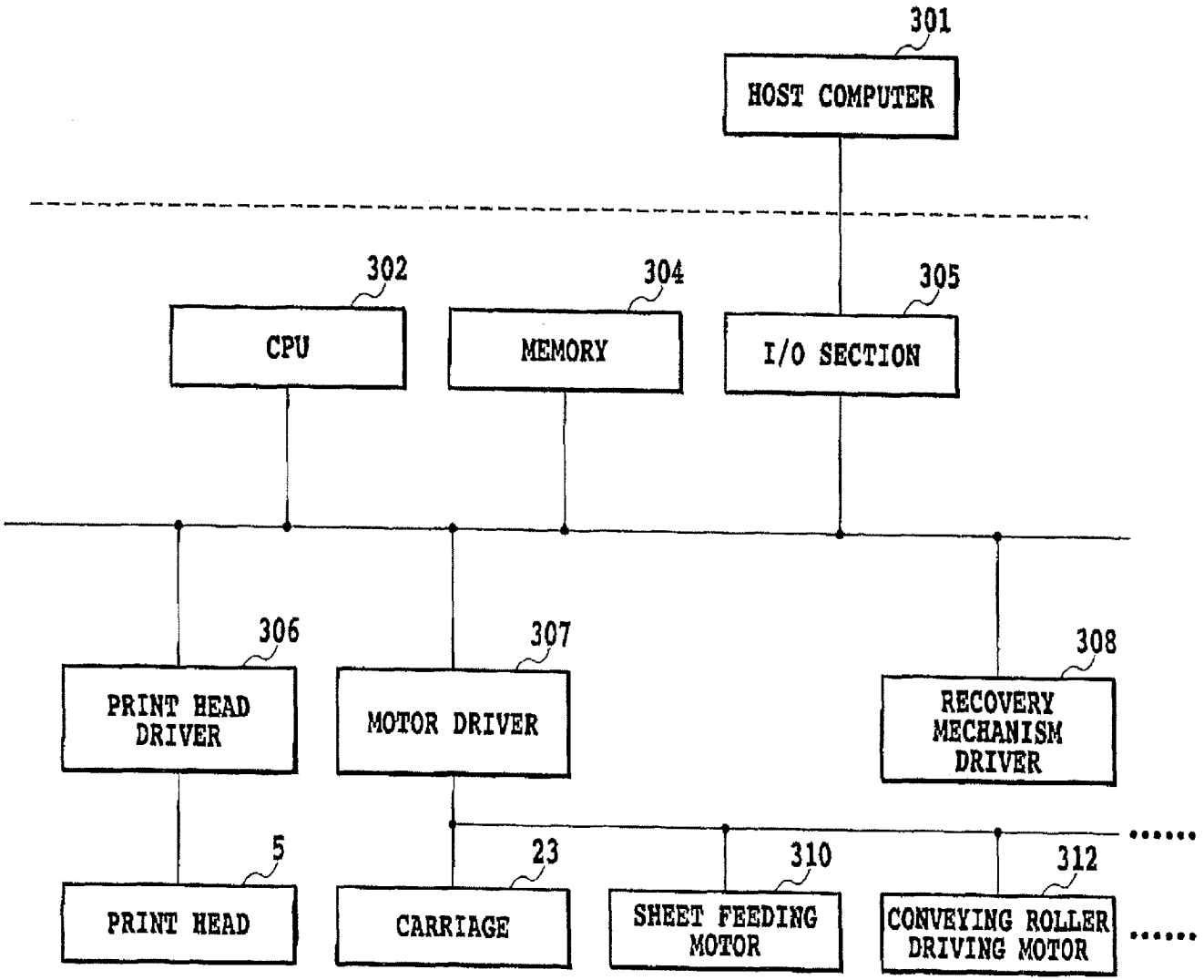
FIG. 8 is a block diagram showing the electric configuration of the ink jet printing apparatus.

With reference to FIG. 8, description will be given of the electric configuration of the ink jet printing apparatus having the above mechanism, that is, a control block.

FIG. 8 is a block diagram showing the electric configuration of the ink jet printing apparatus.

Reference numeral 302 denotes a CPU composed of a microprocessor or the like. Reference numeral 304 is a memory composed of, for example, a ROM that stores control programs executed by the CPU 302 as well as various data and a RAM which is used as a work area for the CPU 302 and which temporarily stores various data such as print image data. Reference numeral 305 denotes an I/O section to which inputs print data supplied by a host computer 301 connected to the ink jet printing apparatus and which outputs data indicating the operation status of the ink jet printing apparatus to the host computer 301.

Reference numeral 306 denotes a print head driver that controls an actuating of the print head 5 in accordance with a drive instruction from the CPU 302. Reference numeral 307 denotes a motor driver that controls actuating of various driving sections such as the carriage motor 23, a sheet feeding motor 310, and a conveying roller driving motor 312, in accordance with a drive instruction from the CPU 302. In addition, for example, a recovery mechanism driver 308 may be provided which drives the recovery mechanism such as the suction pump.

The CPU 302 activates the control programs stored in the memory 304 to drive each driving section via the I/O section 305 in accordance with various pieces of information (for example, a character pitch and the type of characters).

In this ink jet printing apparatus, non-ejection nozzles are detected by periodically printing a test pattern. Though the form of the test pattern is not particularly limited, non-ejection nozzles are conventionally sensed using, for example, a test pattern that as a whole constitutes a step-like line formed by printing a line of a predetermined length for each nozzle.

Data of non-ejection nozzles detected is stored in the ROM or the like in the memory 304. The data is referenced when print data is expanded into ejection data for each nozzle.

Figure 25:
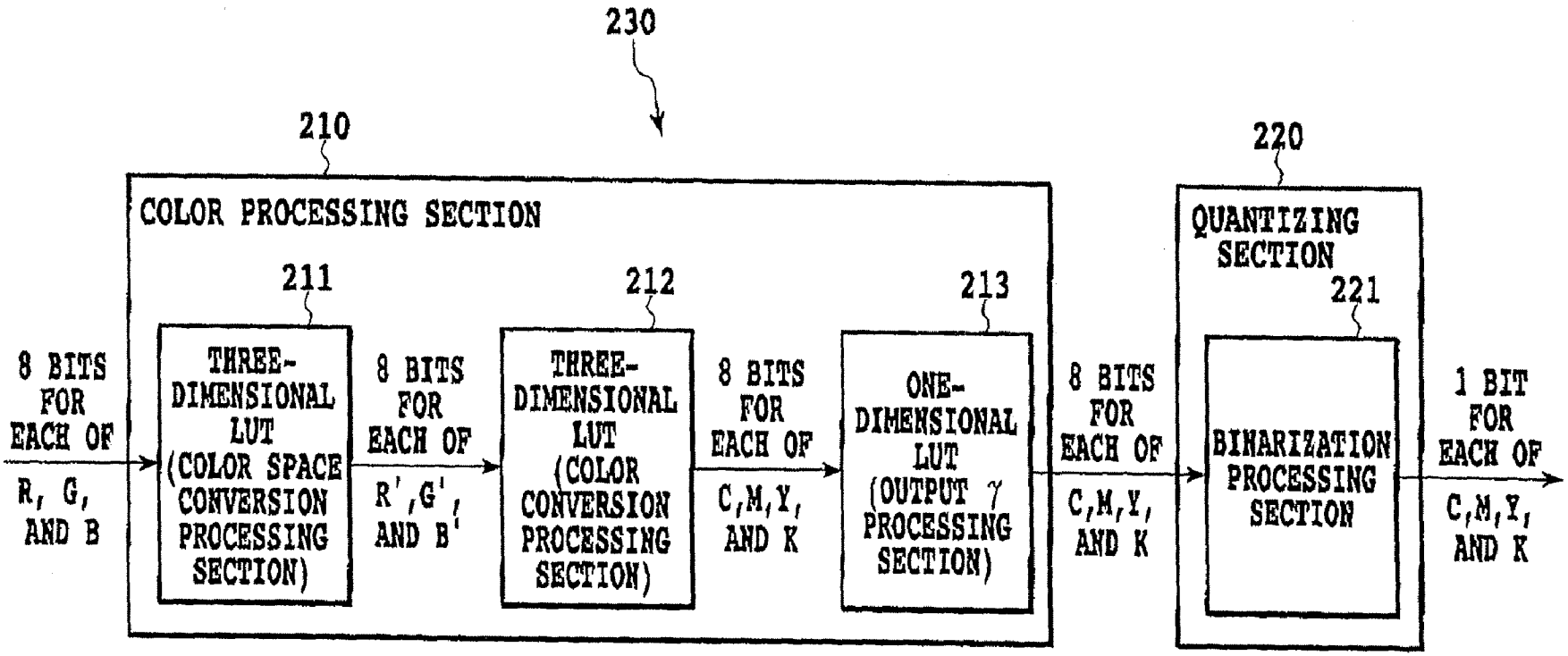
FIG. 25 is a block diagram showing the configuration of an image processing section that processes images.

FIG. 25 is a block diagram of image processing executed by the host computer 301.

In the image processing performed in this section, the host computer 301 processes 8-bit (256-level gradation) of image data on each of R (red), G (green), and B (blue) so as to output 1-bit data on each of C (cyan), M (magenta), Y (yellow), and K (black). The image processing section 230 is composed of a color processing section 210 that converts a color space corresponding to an input device of the host computer 301 (or for example, a digital camera) into a color space corresponding to an output device of the printing apparatus, and a quantizing section 220 that quantizes each color data of image data in accordance with gradation values that can be expressed by the printing apparatus.

Moreover, the color processing section 210 consists of a color space conversion processing section 211, a color conversion processing section 212, and an output γ processing section 213. The color space conversion processing section 211 and the color conversion processing section 212 are each composed of a three-dimensional LUT (Look Up Table). The output γ processing section 213 is composed of a one-dimensional LUT (Look Up Table). The LUTs are stored in the memory of the host computer 301, respectively.

In the color space conversion processing section 211, Eight-bit of image data on each of the R, G, and B read from the storage device 304 is first, converted into 8-bit data of R', G', and B' by referring to the three-dimensional LUT. This processing is called a color space converting process (prehistory-color processing). This converting process is executed to correct the difference between the color space of an input image and a reproduction color space of the output device. Then, the three-dimensional LUT of the color conversion processing section 212 converts the 8-bit data on each of the R', G', and B' which the color space converting process is executed into 8-bit data on each of the C, M, Y, and K. This processing is called a color converting process (post-color processing). This process is executed to convert the RGB-system color of the input system into the CMYK-system color of the output system. Then, the one-dimensional LUT of the output γ processing section 213 cause the output value of the 8-bit data on each of the C, M, Y, and K subjected to the color converting process to be corrected. This process is executed such that an output γ correction is made to ensure the input level of the 8 bits for each of the C, M, Y, and K as well as the linear relationship with the output characteristics since a linear relationship often fails to be established between the number of dots printed per unit area and output characteristics (reflection density and the like).

Image data inputted by the host computer 301 is often additive primary colors (R, G, and B) for a luminous element such as a display. However, when the reflection of light is used to express colors as in the case of printers, color materials for subtractive primaries system (C, M, and Y) are used. Accordingly, the above color converting process is required.

Further, data is discretely held in the three-dimensional LUTs used for the prehistory-color processing and the post-color processing. An interpolating process may be used as a value between the discrete data is determined. The interpolating process is a well-known technique, so that its detailed description is omitted.

Then, the 8-bit data on each of the C, M, Y, and K subjected to the output γ process is given a binarization process in accordance with reproduction gradation that can be expressed by the printing apparatus in a binarization processing section 221 of the quantizing section 220. Thus, the 1-bit data on each of the C, M, Y, and K is outputted from the binarization processing section 221.

In the present embodiment, the quantizing section 220 executes a binarization process. However, the quantizing section may execute a three-level process or four-level process in accordance with gradation that can be expressed by the printing apparatus.

(Corrective Printing Method)

Now, description will be given of a corrective printing method for complementing non-ejection nozzles of print data. The corrective printing method is a way to print on pixels primarily supposed to be printed by non-ejection nozzles using other normal nozzles, the non-ejection nozzles being selected as correction targets using the method shown in the embodiment described later.

The corrective printing method varies between 1-pass printing and multipass printing.

First, a description will be given of a corrective printing method for multipass printing.

Figure 9:
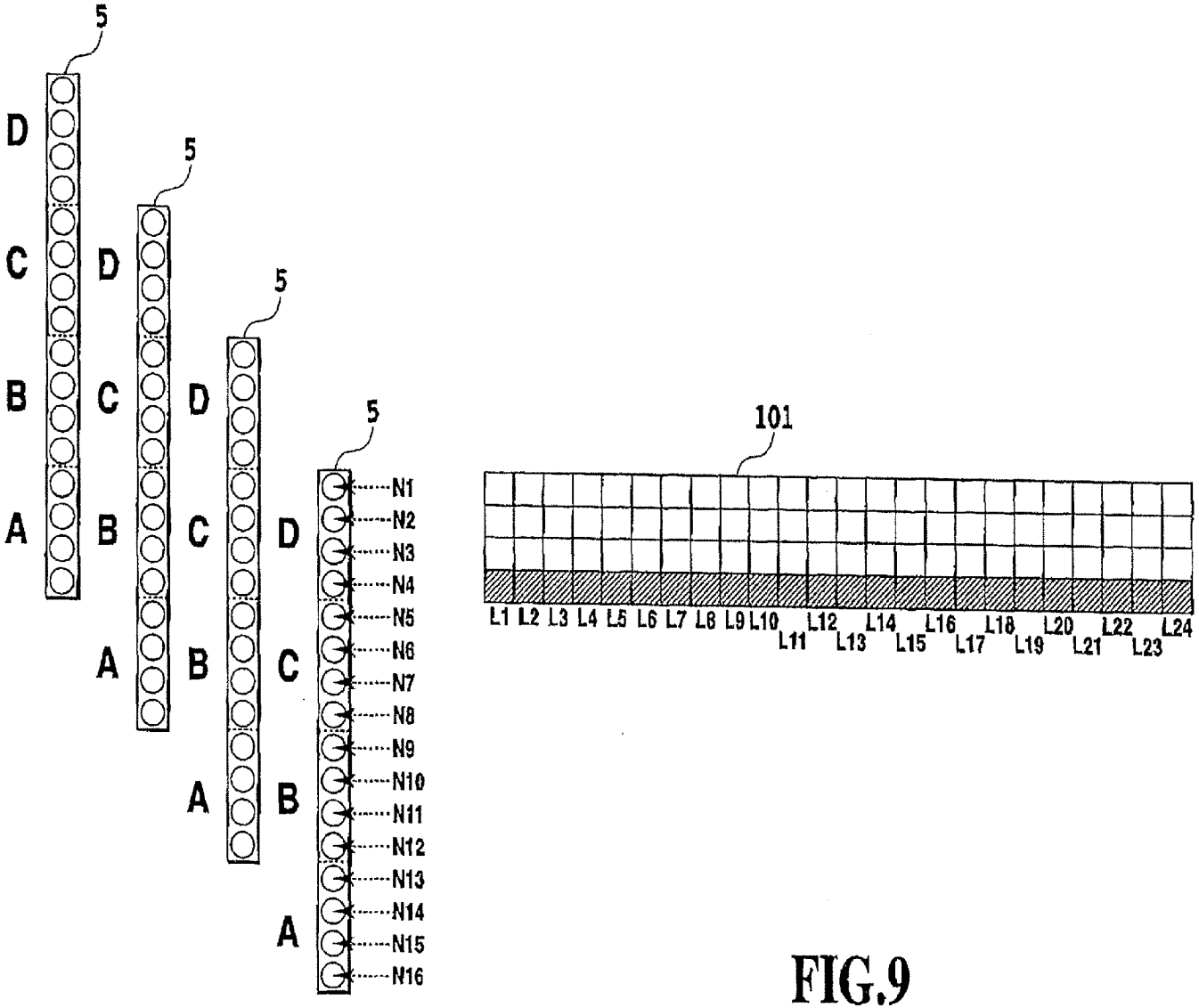
FIG. 9 is a schematic diagram showing the flow of 4-pass printing.

FIG. 9 is a schematic diagram showing the method of multipass printing.

For simplification of explanation, for example, 16 nozzles are constructed in the print head 5. In FIG. 9, reference numeral 101 denotes a print area consisting of a 4 by 24 matrix of pixels. N1 to N16 denote nozzle numbers.

The 16 nozzles in the print head 5 are divided into four blocks A, B, C, and D each of which is composed of four nozzles. An image is formed by repeating a printing operation which scans the print head 5 in the main scanning direction, over the print area corresponding to one block consisting of four nozzles and a conveying operation which the conveying operation feeds the sheet by a distance corresponding to the four nozzles four times, and.

That is, the print area 101 for one block measures a area consisting of a 4 by 24 matrix of pixels. As shown in FIG. 9, an image is completed by scanning the print head 5 four times in the main scanning direction in order of the A, B, C, and D blocks.

Attention will be paid to one raster in the print area 101, that is, the shaded areas (one raster) in FIG. 9. To complete the image equal to an area for one raster, the print head 5 scans in the main scanning direction during the first print scan. The nozzle having the nozzle number N16 in the A block prints on predetermined pixels. Then, after the sheet is fed by a distance corresponding to four nozzles in the sub-scanning direction, which is orthogonal to the main scanning direction, the print head 5 is scanned to carry out printing using the nozzle having the nozzle number N12 in the B block. Similarly, after the sheet has been fed by a distance corresponding to four nozzles, printing is carried out using the nozzle having the nozzle number N8 in the C block. Finally, printing is carried out using the nozzle having the nozzle number N4 in the D block to complete printing on the predetermined pixels.

In other words, in 4-pass printing, the four nozzles having the nozzle numbers N4, N8, N12, and N16 are used to print on the print area for shaded one raster in FIG. 8.

Figure 10A:
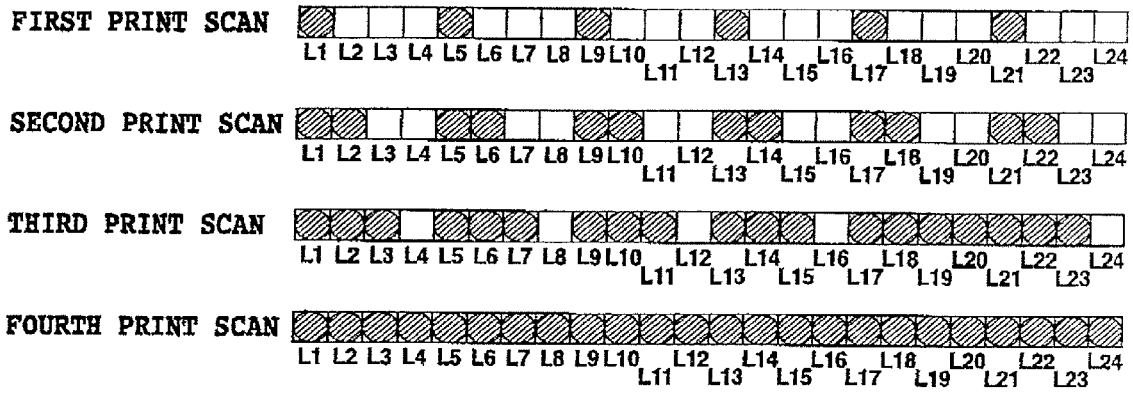
FIG. 10A is a diagram showing the flow of printing of one raster in multipass printing in which all nozzles are normal.
Figure 10B:
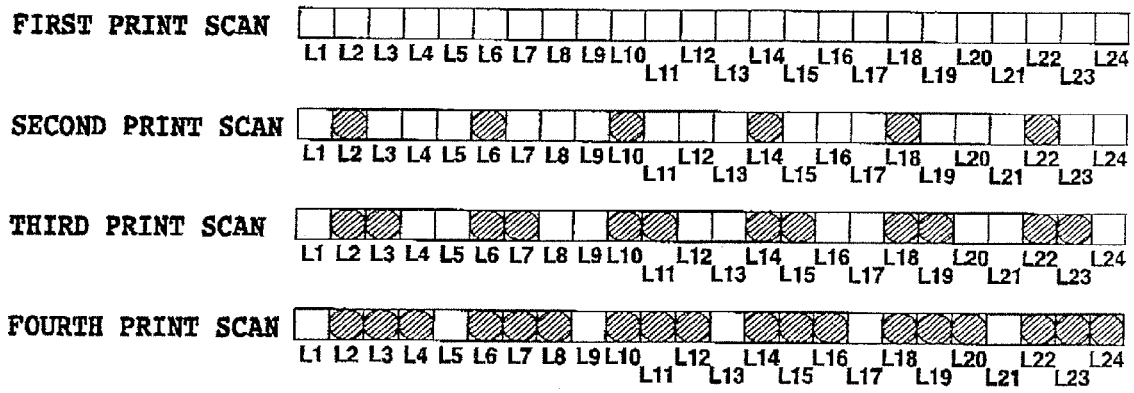
FIG. 10B is a diagram showing the flow of printing of one raster in multipass printing in which a nozzle N16 is in a non-ejection state.
Figure 10C:
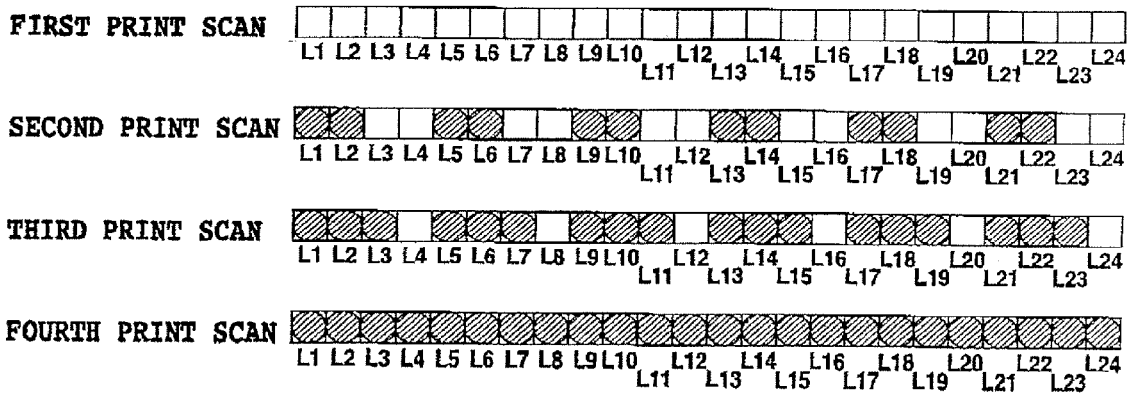
FIG. 10C is a diagram showing the flow of printing of one raster in multipass printing in which a nozzle N16 is in a non-ejection state and in which a nozzle N12 is used for correction.

Here, FIGS. 10A to 10C show pixels which are obtained from the area corresponding to shaded one raster in the print area 101 in FIG. 9 and to which numbers from L1 to L24 are assigned for each pixel.

FIG. 10A shows the results of each print scan (first to fourth print scans) obtained when all nozzles are normal. In FIG. 10A, dots shown in the first print scan and formed at each pixel having pixel numbers L1, L5, L9, L13, L17, and L21 represent dots printed by using the nozzle having the nozzle number N16 in the print head 5 during the first print scan. Further, those of the dots shown in the second print scan which are other than the dots already printed during the first print scan, that is, the dots formed at each pixel having the pixel numbers L2, L6, L10, . . . , represent dots printed by using the nozzle having the nozzle number N12 in the print head 5. Similarly, in the third print scan, the nozzle having the nozzle number N8 is used for printing. In the fourth print scan, the nozzle having the nozzle number N4 is used for printing. In the third and fourth print scans, dots printed in the respective scans are additionally shown with the dots already printed.

That is, during the first print scan, by using the nozzle having the nozzle number N16, dots are formed at the pixels having the pixel number Ln+1 (n=0, 1, 2, 3, . . . ). During the second print scan, by using the nozzle having the nozzle number N12, dots are formed at the pixels having the pixel number Ln+2 (n=0, 1, 2, 3, . . . ). During the third print scan, by using the nozzle having the nozzle number N8 dots are formed at the pixels having the pixel number Ln+3 (n=0, 1, 2, 3, . . . ). During the fourth print scan, by using the nozzle having the nozzle number N4 dots are formed at the pixels having the pixel number Ln+4 (n=0, 1, 2, 3, . . . ). In this manner, the printing performed in each scan allows the area corresponding to one raster to be completely printed in four print scans.

Here, let us assume that the nozzle having the nozzle number N16 is a non-ejection nozzle. Then, as shown in FIG. 10B, the pixels having the pixel number Ln+1 (n=0, 1, 2, 3, . . . ) supposed to be printed during the first print scan are not printed. Consequently, after the four print scan has finished, the pixels having the pixel number Ln+1 are blank. Therefore, as a result of following the end of the 4-pass printing, pixels having the pixel number Ln+1 are only scattered with missing dots. However, since one line is spotted with pixel missing dots, the entire one line appears to be missing dots depending on the size of the dots or the number of passes. In other words, a white line is formed.

To prevent blank pixels at which no dots are formed, complementation (correction) is carried out by using another normal nozzle to form dots at the pixels during another print scan. In the 4-pass printing, in which printing corresponding to one raster is carried out in four print scans, four nozzles are normally used to perform a printing operation. To execute complementary printing on pixels otherwise formed during the first print scan using the nozzle having the nozzle number N16, which has become a non-ejection nozzle, the nozzle (in this case, any of the nozzles N4, N8, and N12) corresponding to another print scan is used to print the pixels Ln+1 during this print scan.

Specifically, as shown in FIG. 10C, if the nozzle having the nozzle number N12 is used for correction, the data corresponding to the pixels having the pixel number Ln+1 printed using the nozzle having the nozzle number N12 is corrected so that the data corresponding to the pixels having the pixel number Ln+1 printed using the nozzle having the nozzle number N16 is added to the data printed using the nozzle having the nozzle number N12. This allows printing based on the data corrected.

Such corrective printing (complementary printing) enables complete printing even if any nozzle becomes defective and cannot eject ink normally. This is because the print data and the dots formed have a one-to-one correspondence. Further, in this case, the nozzle having the nozzle number N12 is used for correction. However, the nozzle having the nozzle number N4 or N8 may be used for correction. Moreover, the data printed using the nozzle having the nozzle number N16 may be divided into three pieces that are added to data printed using the nozzles having the nozzle numbers N4, N8, and N12. That is, printing may be carried out using the three nozzles to correct the respective pixels.

The present example has been described in connection with 4-pass printing. For another multipass printing in which a different number of passes are used for printing, complementary printing may be carried out by assigning data to be printed by a non-ejection nozzle to data printed by a plurality of normal nozzles used to print the same raster.

Now, description will be given of a corrective printing method for 1-pass printing.

In 1-pass printing, only one nozzle is used to print one raster. It is thus impossible to assign data to be printed by a non-ejection nozzle to data printed by other nozzles used for the same raster as in the case of the multipass printing. Thus, in correction for 1-pass printing, data to be printed by a non-ejection nozzle is assigned to data printed by nozzles arranged adjacent to the non-ejection nozzle in the vertical direction. Then, the adjacent nozzles carry out corrective printing.

As shown in FIG. 1A, the nozzle having the nozzle number N15, sandwiched between the normal nozzles having the nozzle numbers N14 and N16, is a non-ejection nozzle.

Figure 11A:
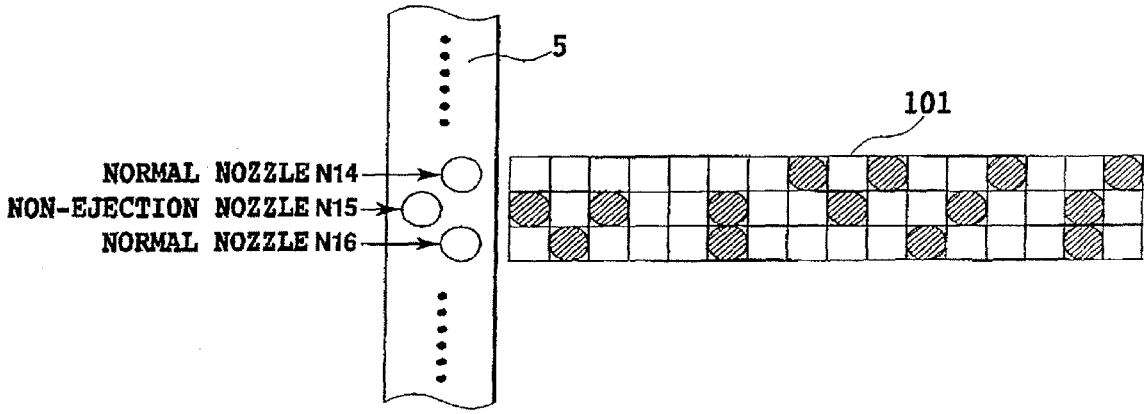
FIG. 11A is a diagram showing a print pattern of a non-ejection nozzle N15 and normal nozzle N14 and N16 in one-pass printing.
Figure 11B:
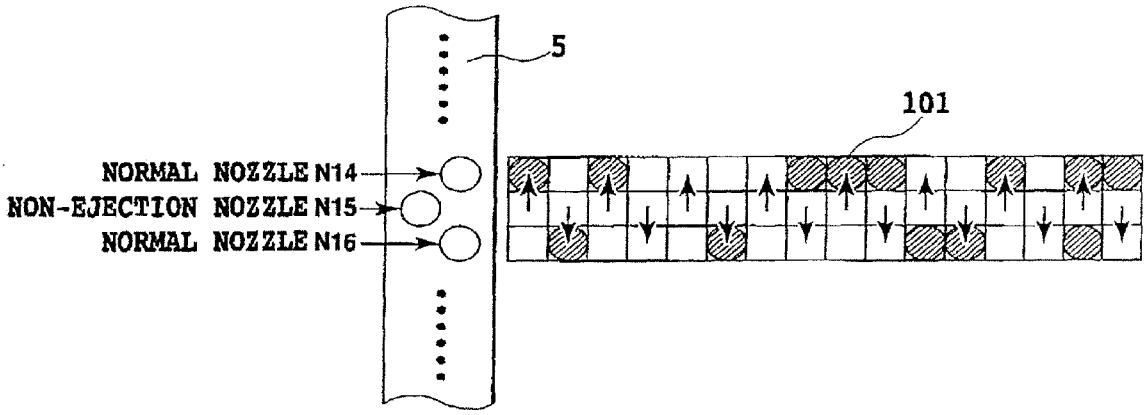
FIG. 11B is a diagram showing a print pattern for which the part corresponding to printing area of the non-ejection nozzle N15 is corrected using the normal nozzles N14 and N16.

If there are data printed by the nozzles having the nozzle numbers N14, N15, and N16 in the print area 101, the data to be printed by the nozzle having the nozzle number N15, a non-ejection nozzle, is assigned to the data printed by the nozzles adjacent to the nozzle N15 in the vertical direction. FIG. 11B shows dots formed by the nozzles having the nozzle numbers N14 and N16 on the basis of print data obtained by adding the data assigned to the data printed by the nozzles having the nozzle numbers N14 and N16.

However, the assignment is not carried out if data is already present at the destination. In this case, a logical OR calculation is executed on the print data otherwise printed using the nozzles having the nozzle numbers N14 and N16 and the print data which corresponds to the print area to be printed by the nozzle having the nozzle number N15 and which is assigned to the data printed by the nozzle having the nozzle number N14. The data obtained is printed using the nozzle having the nozzle number N14. Further, the raster data corresponding to the data printed by the nozzle having the nozzle number N15 is masked because the nozzle having the nozzle number N15 is anon-ejection nozzle. Then, after correction, the data printed by the nozzle having the nozzle number N15 is set as null data.

In this case, the data for the non-ejection nozzle is assigned to the data printed by the two vertically adjacent nozzles. However, the data for the non-ejection nozzle may be assigned to the data printed by one of the two vertically adjacent nozzles.

In this manner, correction is made by assigning data to be printed by a non-ejection nozzle to data printed by adjacent nozzles. In this case, pixels to be printed by the non-ejection nozzle are not printed, and printing is substitutively carried out on the adjacent rasters. Accordingly, the missing part of the image is not perfectly corrected.

However, compared to the case in which a non-ejection nozzle eliminates all the data for one raster, since printing is carried out on the surrounding rasters, the white line is greatly reduced to improve image quality.

According to the present invention, such a correcting process is not executed on all the non-ejection nozzles but only on some non-ejection nozzles selected. Thus, description will be given of a method for selecting non-ejection nozzles to be corrected.

FIRST EMBODIMENT

In the present embodiment, description will be given of a method for selecting non-ejection nozzles to be corrected, on the basis of the positional relationship among non-ejection nozzles in the print head 5.

First, description will be given of anon-ejection nozzle in the print head and how a white line appears.

Figure 12:
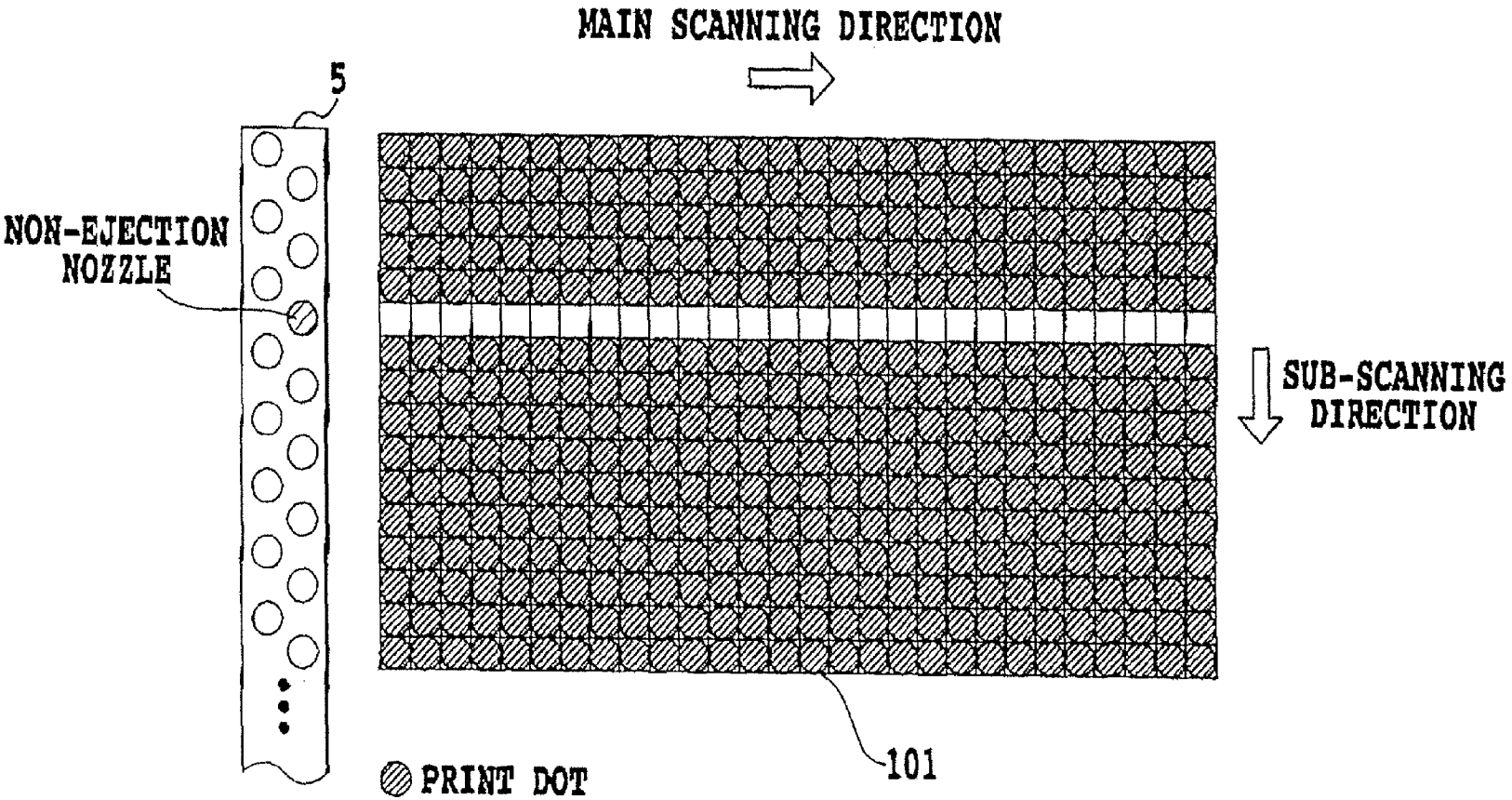
FIG. 12 is a diagram showing a white line resulting from missing dots corresponding to a non-ejection nozzle.

FIG. 12 is a schematic diagram showing a white line appearing as a result of a failure to eject ink.

If there is any non-ejection nozzle in the print head 5, the raster to be printed by the non-ejection nozzle is not printed. Consequently, a white line appears in the image in the main scanning direction as shown in FIG. 12.

FIG. 12 shows 1-pass printing involving only one non-ejection nozzle. If there are a plurality of non-ejection nozzles, the appearance of white lines in the image varies depending on the positional relationship among the non-ejection nozzles in the print head 5.

Description will be given, by way of example, of a print head in which two nozzles are non-ejection nozzles.

Figure 13A:
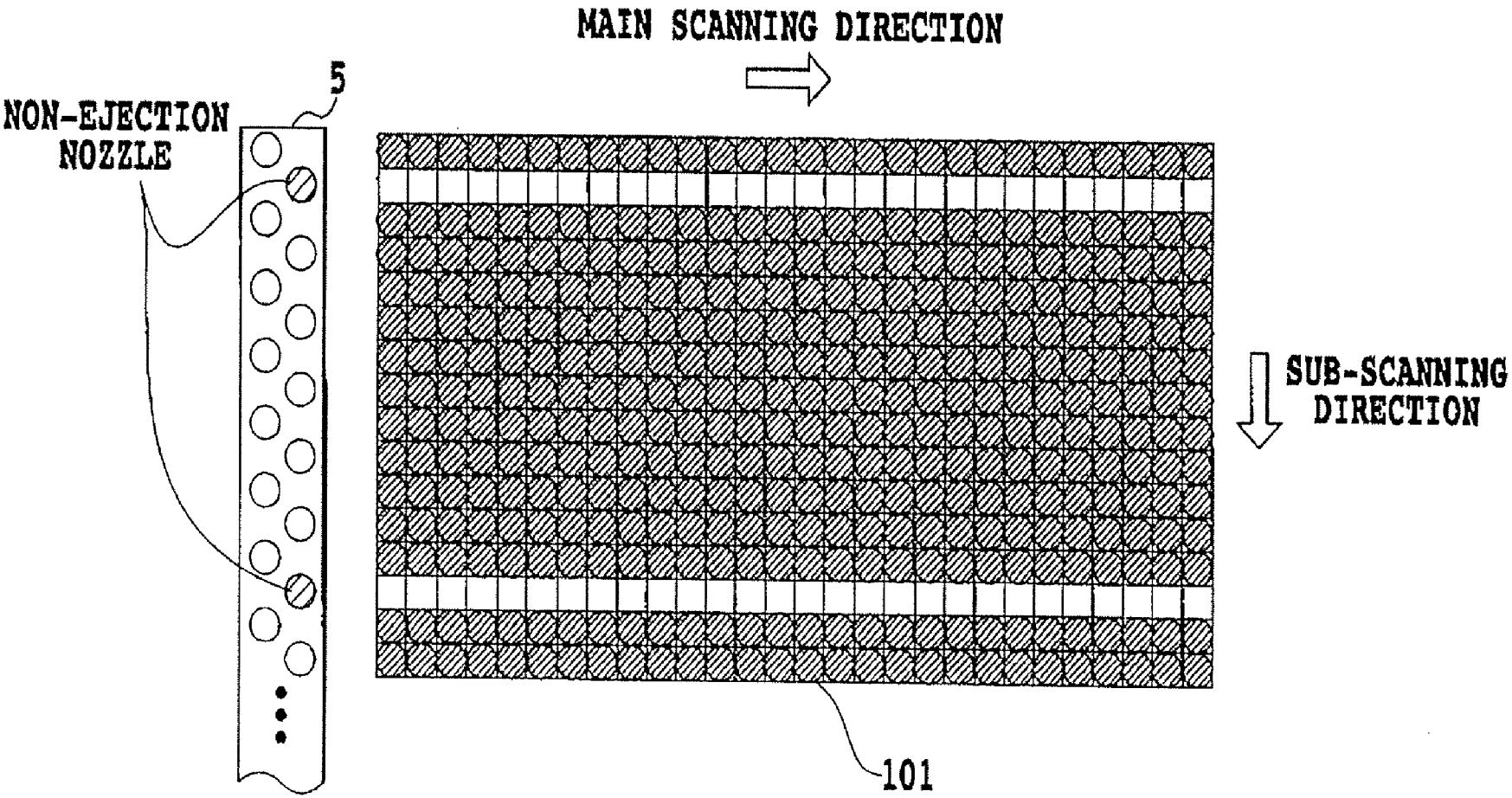
FIG. 13A is a diagram showing white lines occurring if there is a large spacing between two non-ejection nozzles.
Figure 13B:
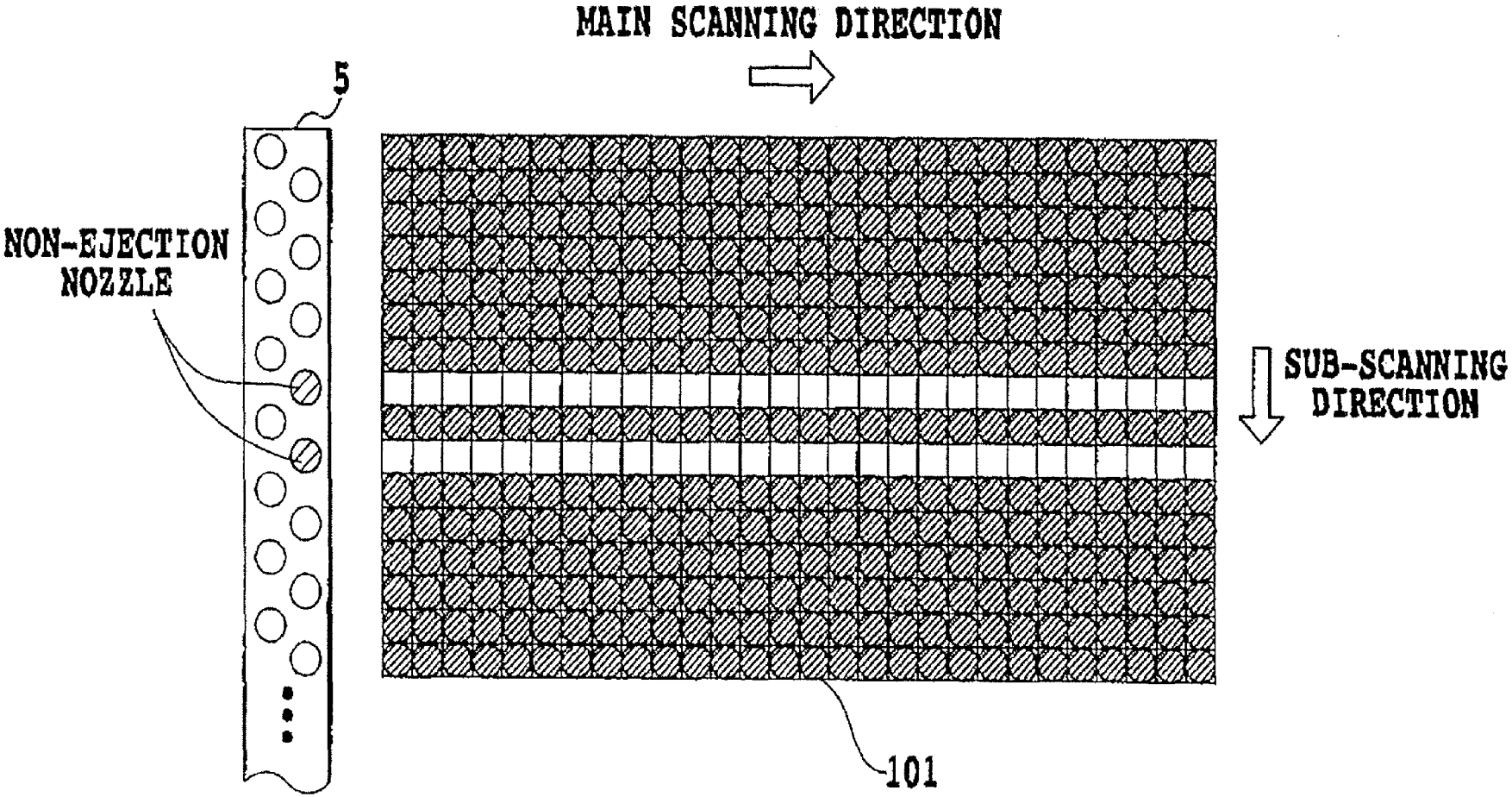
FIG. 13B is a diagram showing white lines occurring if there is a narrow spacing between two non-ejection nozzles.

FIG. 13A shows white lines observed if there is a large spacing between the non-ejection nozzles. FIG. 13B shows white lines observed if there is only a small spacing between the non-ejection nozzles.

If there is only a small spacing between the non-ejection nozzles, the two white lines are closer to each other than if there is a large spacing between the non-ejection nozzles. Accordingly, these stripes are emphasized and appear as one thick white line. In other words, the two white lines closer to each other are perceived as a clear white line that is striking in the image.

Because of the emphasizing action of white lines, even if for example, one white line alone is not visually perceived as a white line and does not affect the image, two white lines close to each other are perceived as a clear white line. This significantly degrades the image quality.

To deal with a visual change in white lines attributed to the positional relationship in the print head 5, the present embodiment selects non-ejection nozzles to be corrected on the basis of positional information on non-ejection nozzles.

Then, corrective printing is executed on the non-ejection nozzles selected as correction targets.

Description will be given of a method for selecting non-ejection nozzles to be corrected.

If there are a plurality of non-ejection nozzles, non-ejection nozzles to be corrected are selected on the basis of positional information on the non-ejection nozzles in the print head 5 in order to correct only the non-ejection nozzles that may affect the image quality. As described above, the non-ejection nozzles are pre-sensed by recording a non-ejection nozzle sensing pattern. Accordingly, data indicating a list of the non-ejection nozzles stored in the ROM or the like is called. Then, the selecting method described below is used to select non-ejection nozzles determined to affect the image quality.

In the print head 5 of the present embodiment, for example, each of the cyan, magenta, and yellow ink plates is configured to have 1,280 nozzles. The black ink plate is configured to have 640 nozzles.

Figure 14:
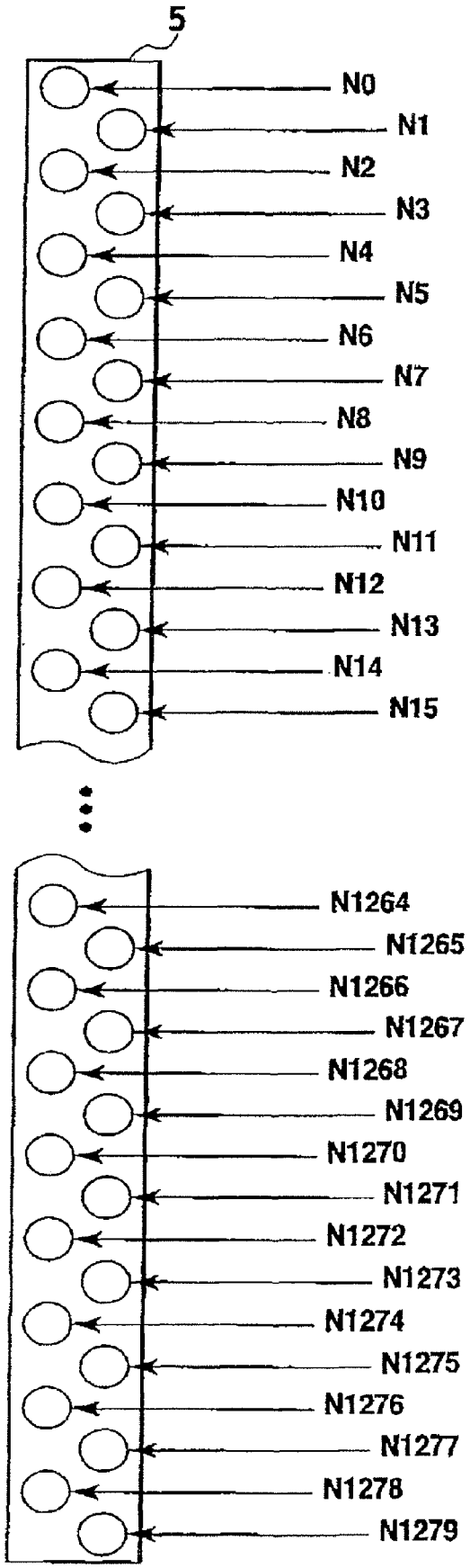
FIG. 14 is a diagram showing nozzle numbers for a color print head.

As shown in FIG. 14, nozzle numbers N0 to N1,279 are assigned to the color ink nozzles. Nozzle numbers N0 to N639 are assigned to the black ink nozzles.

The arrangement of the nozzles in the black ink plate is the same as that in the color ink plate, so that its illustration is omitted.

If there are two non-ejection nozzles, a nozzle spacing set value is defined as a nozzle spacing corresponding to a sufficient distance between the non-ejection nozzles to prevent a white line from being perceived in the image or from disturbing a viewer.

The nozzle spacing set value will be described.

Description will be given of the nozzle spacing set value in connection with 30 nozzles (about 635 μm).

Figure 15:
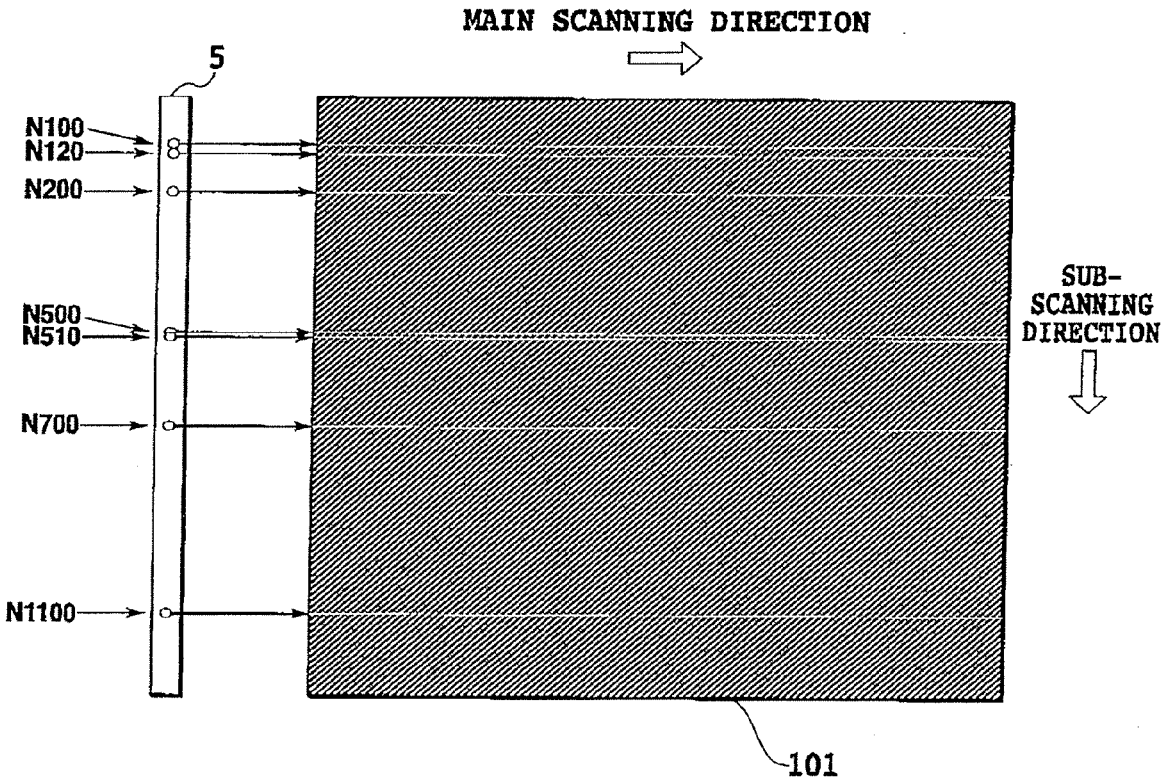
FIG. 15 is a diagram showing an example of white lines in one-pass printing.

FIG. 15 is a diagram schematically showing white lines formed if nozzles having nozzle numbers N100, N120, N200, N500, N510, N700, and N1100 are non-ejection nozzles and if 1-pass printing is carried out in which the print head 5 prints the print area 101 corresponding to the width of the plates during one print scan.

As seen in FIG. 15, white lines occur at the positions shown on the image. FIG. 15 shows that all the pixels in the print area 101 have been printed. In this case, the image quality is affected if the nozzle spacing between non-ejection nozzles is no more than 30 nozzles. No white lines appear in the image if the non-ejection nozzles are separated from each other by more than 30 nozzles.

That is, a print matter with a sufficient image quality is obtained by executing corrective printing on a non-ejection nozzle for which the nozzle spacing is determined to be no more than 30 nozzles.

Thus, the distance between non-ejection nozzles is calculated on the basis of the nozzle numbers. Non-ejection nozzles to be corrected are then selected on the basis of the distances between the non-ejection nozzles. The nozzle spacing between the non-ejection nozzles is easily calculated; for example, it can be calculated to be 20 nozzles (about 423 μm) for the nozzle numbers N100 and N120. If there are a plurality of non-ejection nozzles in the print head as described above, all the distances between the non-ejection nozzles are calculated.

However, if the entire image is completed in a plurality of print scans, attention must be paid to the determination of the distance between the last non-ejection nozzle in the first printing pass and the first non-ejection nozzle in the second printing pass.

Figure 16:
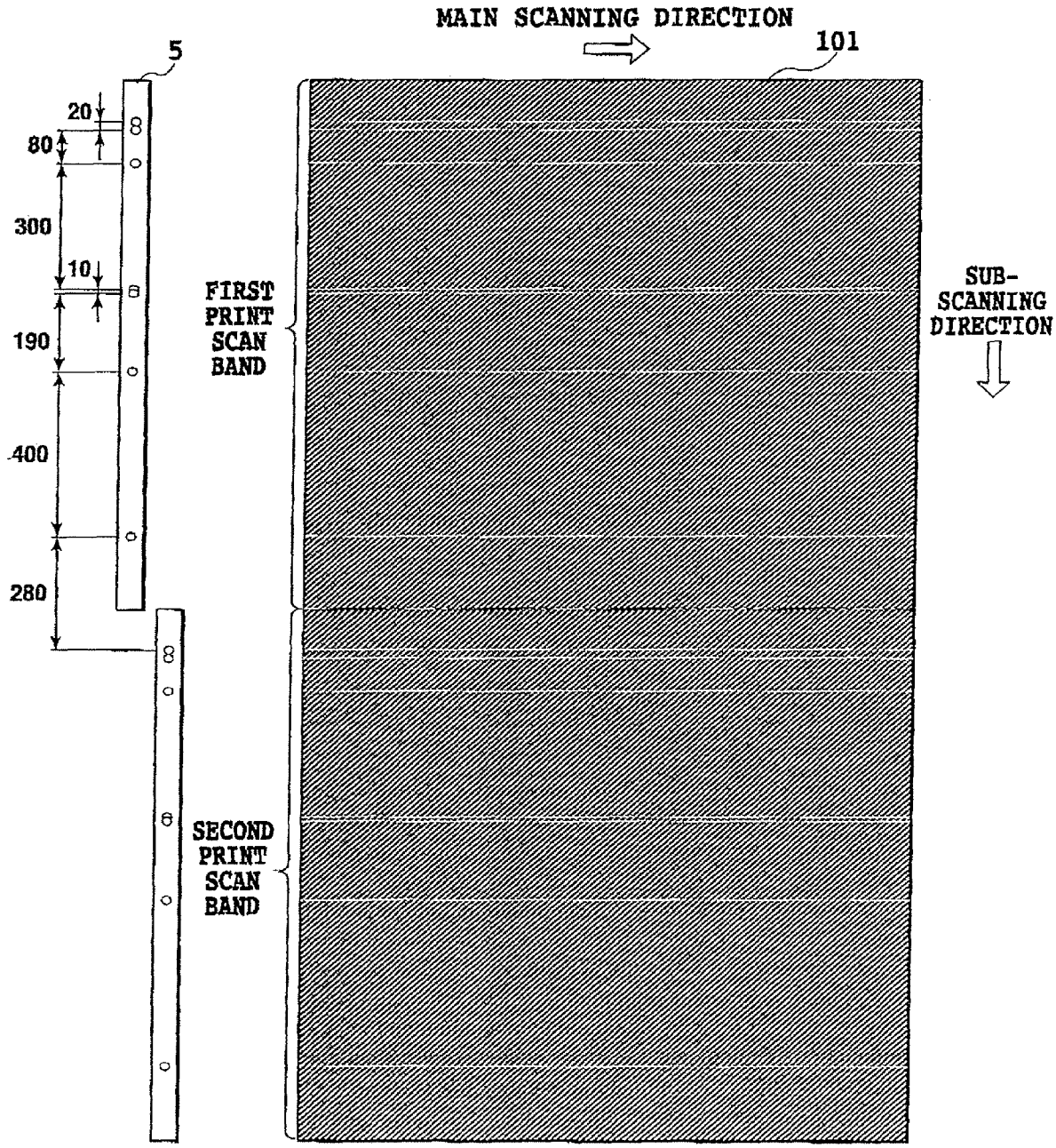
FIG. 16 is a diagram showing an example of white lines that occurred when two bands were printed in one-pass printing.
Figure 17:
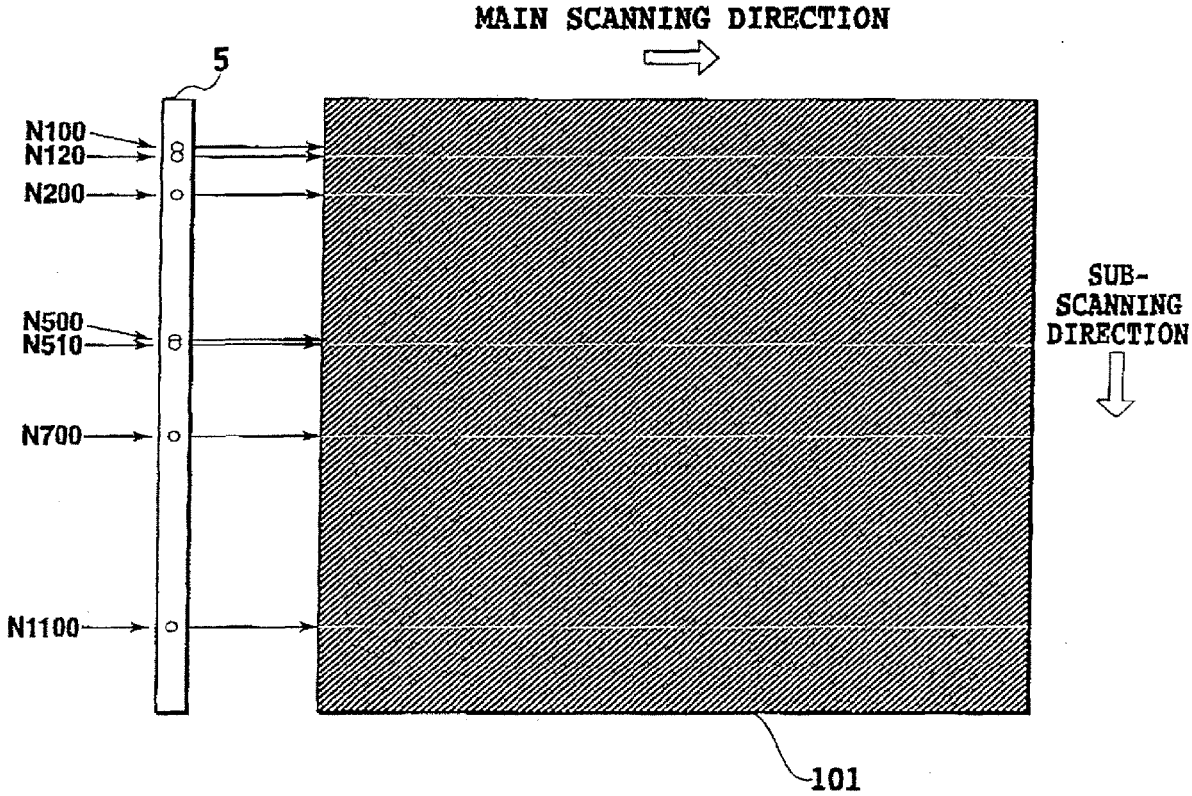
FIG. 17 is a diagram showing the results of printing carried out so as to correct printing area of non-ejection nozzle portions to be corrected.

If an image is completed by printing one band during one print scan, then feeding the sheet in the sub-scanning direction by a distance corresponding to one band, and printing one band again during the next print scan, then on the image formed, a raster printed by the nozzle located at the upper end of the print head 5 is adjacent to a raster printed by the nozzle located at the lower end of the print head 5. Thus, the nozzle spacing between the smallest nozzle number and the largest nozzle number is calculated as follows taking the sheet feeding in the sub-scanning direction into account. In the present example, this corresponds to the nozzle numbers N100 and N110. As shown in FIG. 16, with the sheet feeding taken into account, 280, the sum of 100 and 180, is the nozzle spacing between the nozzles having the nozzle numbers N100 and N1100.

Then, non-ejection nozzles to be corrected are selected on the basis of the calculated nozzle spacings. The image quality is affected by a combination of non-ejection nozzles with a nozzle spacing of no more than 30. In this case, combinations with a nozzle spacing of no more than 30 are a combination of the nozzle numbers N100 and N120 and a combination of the nozzle numbers N500 and N510. The nozzle with smaller nozzle number is selected from each of the combinations with a nozzle spacing of no more than 30 as a non-ejection nozzle to be corrected. In this case, the nozzle numbers N100 and N500 are selected.

As described above, the non-ejection nozzles to be corrected are selected on the basis of the positional information on the non-ejection nozzles in the print head 5.

Corrective printing is executed on the pixels to be printed by the non-ejection nozzles selected as correction targets, using the corrective printing method described in connection with the 1-pass printing as well as other normal nozzles adjacent to the non-ejection nozzles. When the corrective printing is executed only on the pixels for the non-ejection nozzles to be corrected, the white lines created by the non-ejection nozzles to be corrected disappear. This eliminates the combination of non-ejection nozzles with a nozzle spacing set value of 30 which affects the image quality. A sufficient image quality is thus obtained. Moreover, by selecting non-ejection nozzles to be corrected, it is possible to reduce the number of normal nozzles used for corrective printing in association with non-ejection nozzles.

The present embodiment has been described in conjunction with 1-pass printing in which a print area is completely printed during one print scan, by way of example. However, in multipass printing in which printing is completed in a plurality of print scans, nozzles to be corrected may also be selected as follows on the basis of the positional information on the non-ejection nozzles in the print head 5.

The selecting method will be described below in connection with 2-pass printing. In the 2-pass printing, during the first print scan, nozzles having nozzle numbers N640 to N1279 are used to print 50% of the print pixels in the entire print area. Then, the sheet is fed in the main scanning direction by a distance corresponding to 640 pixels (1,200 dpi). During the second print scan, nozzles having nozzle numbers N0 to N639 are used to print remaining 50% of the print pixels. The image in the entire print area is completed in the two print scans.

Figure 18:
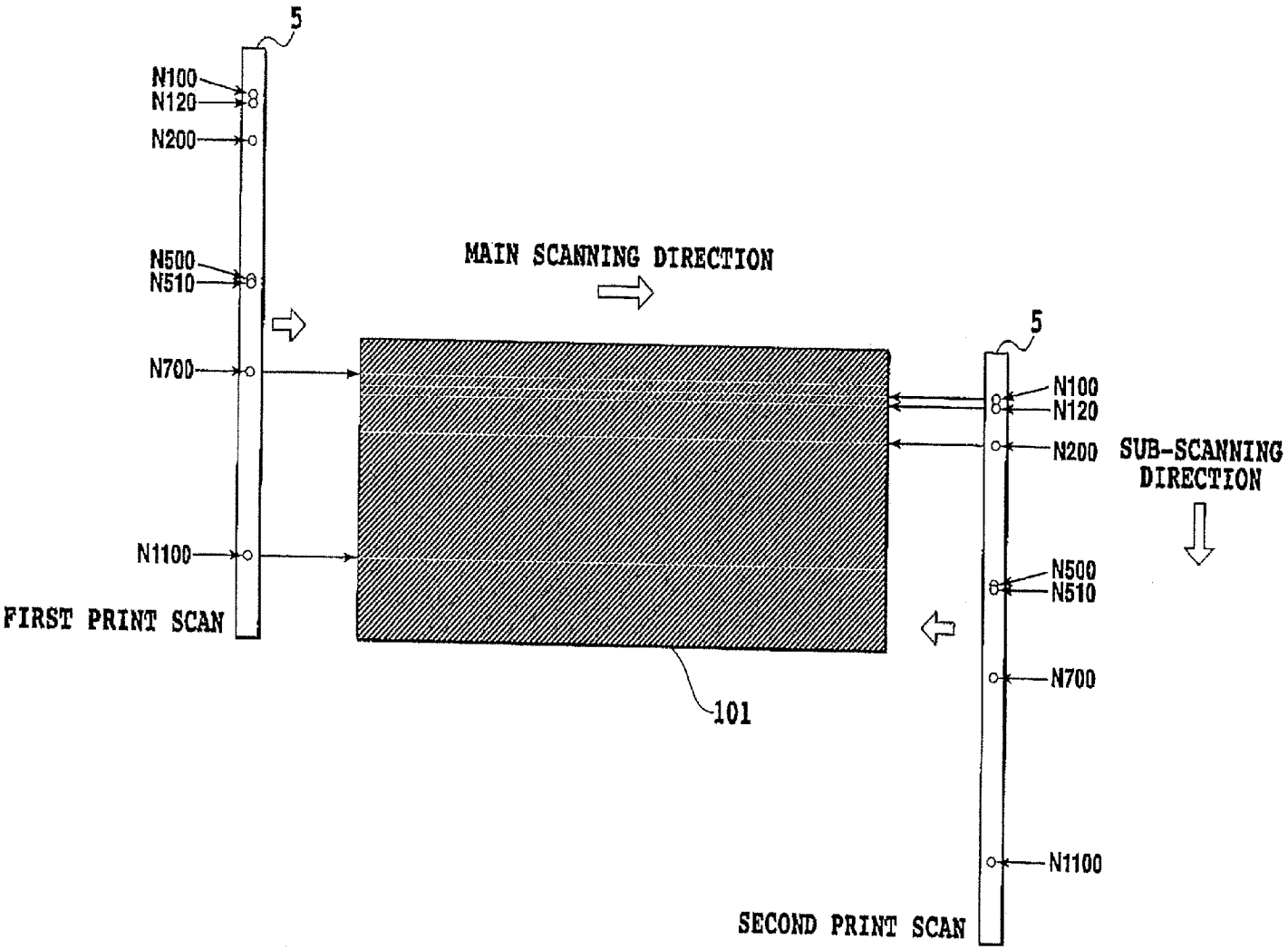
FIG. 18 is a diagram showing an example of white lines in 2-pass printing.

FIG. 18 is a schematic diagram showing the positional relationship between the print head 5 and the print area 101 during the first and second print scans. If the nozzles having the nozzle numbers N100, N120, N200, N500, N510, N700, and N1100 are non-ejection nozzles, white lines resulting from the non-ejection nozzles appear at the positions shown in FIG. 18.

Rasters appearing as the white lines are actually missing dots corresponding to pixels. However, each of these rasters is visually perceived as one white line.

Figure 19:
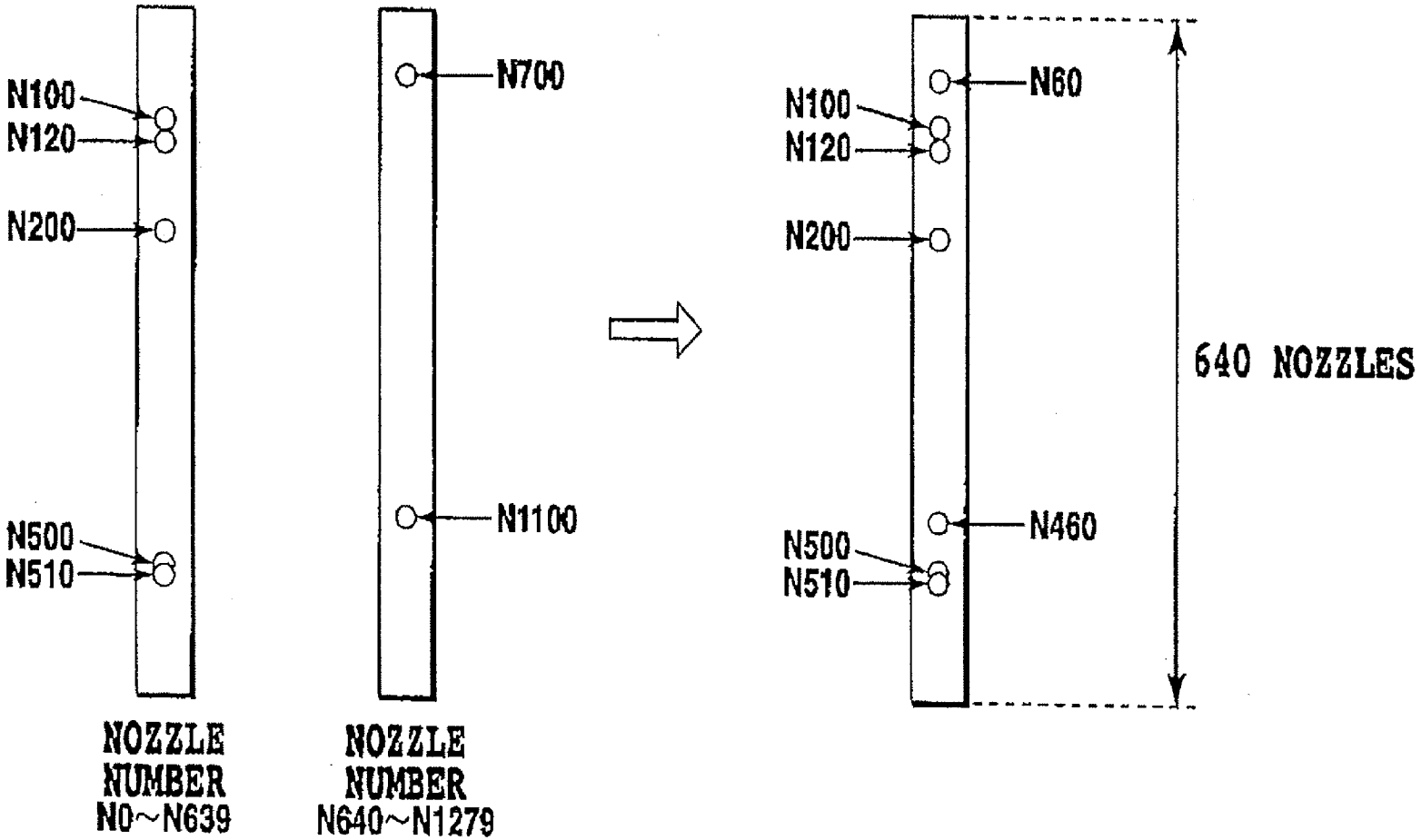
FIG. 19 is a diagram indicating how to calculate the spacing between non-ejection nozzles.

Thus, the positional relationship between the print head 5 and the print area 101 is determined taking the sheet feeding into account. As shown in FIG. 19, the nozzle spacings are calculated by subtracting 640 from the nozzle numbers N640 to N1279 and subjecting these nozzles and those having the nozzle numbers N0 to N639 to logical OR. In this case, the nozzle numbers N700 and N1100 are converted into the nozzle numbers N60 and N460, respectively. Then, the nozzle spacings between the non-ejection nozzles are calculated on condition that the nozzles having the nozzle numbers N60, N100, N120, N200, N460, N500, and N510 are non-ejection nozzles and that the total number of nozzles is 640.

Subsequently, combinations of non-ejection nozzles with a nozzle spacing of no more than a set value are searched for on the basis of the nozzle spacings between the non-ejection nozzles calculated as in the case of the 1-pass printing. The nozzle with the smaller nozzle number is selected from each of the combinations searched for, is to be corrected.

Description has been given of the method for selecting nozzles to be corrected for 2-pass printing. For other multipass printing, a similar method may be used to select nozzles to be corrected taking into consideration the positional relationship between the print head 5 and the print area 101 in connection with the sheet feeding.

In the present example, the nozzle with the smaller nozzle numbers is selected from each of the combinations with a nozzle spacing set value of at least 30 as a correction target.

However, the present invention is not limited to this example. For example, one of the non-ejection nozzles which has the larger nozzle number may be selected as a correction target.

Alternatively, nozzles to be corrected may be selected on the basis of positional relationship with surrounding nozzles. For example, for a combination of the nozzle numbers N500 and N510, the nozzle spacing (300) between the nozzle number N500 and the nozzle number N200, constituting another combination, may be compared with the nozzle spacing (190) between the nozzle number N510 and the nozzle number N700, constituting another combination. Then, the nozzle number N510, involving the smaller spacing, may be selected. That is, nozzles to be corrected may be selected on the basis of the positional information on the surrounding nozzles.

In the present embodiment, the nozzle spacing set value is no more than 30. However, the nozzle spacing set value is not limited to 30 nozzles but may be set at an arbitrary value depending on conditions.

Further, in the present embodiment, the distance between non-ejection nozzles is calculated on the basis of nozzle numbers. However, the nozzle numbers need not necessarily be used in order to determine the distance. Another method may be used to determine the distance between non-ejection nozzles.

SECOND EMBODIMENT

In the present embodiment, description will be given of the order in which if there are a plurality of combinations of non-ejection nozzles with a nozzle spacing of no more than a set value, nozzles to be corrected are selected from the non-ejection nozzles.

Description will be given of an example in which 1-pass printing and a nozzle spacing set value of 30 nozzles are used and in which the ink cannot be ejected from the nozzles having the nozzle numbers N100, N120, N200, N500, N510, N700, and N1100.

Figure 20A:
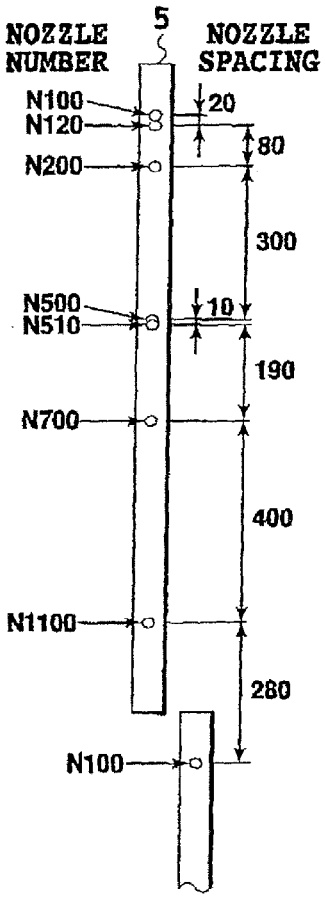
FIG. 20A shows that there are plurality of combinations of non-ejection nozzles with a nozzle spacing of less than a predetermined value, the spacing between nozzles N100 an N120 and the spacing between nozzles N500, and N510 both being no more than 30 nozzles.

The nozzle spacing between non-ejection nozzles can be calculated on the basis of nozzle numbers. As shown in FIG. 20A, on the basis of the nozzle spacings calculated, combinations of non-ejection nozzles with a nozzle spacing set value of no more than 30 are a set of nozzles having the nozzle numbers N100 and N120 and a set of nozzles having the nozzle numbers N500 and N510. If there are a plurality of combinations with a nozzle spacing of no more than the set value as described above, the combination with the smallest nozzle spacing is first selected as nozzles to be corrected.

In this case, a combination of the nozzle numbers N100 and N120 has a nozzle spacing of 20 nozzles. A combination of the nozzle numbers N500 and N510 has a nozzle spacing of 10 nozzles. Accordingly, the combination of the nozzle numbers N500 and N510 has the smaller nozzle spacing. Thus, first, the nozzle with the smaller number, the nozzle number N500, may be selected from the combination of the nozzle numbers N500 and N510 as a nozzle to be corrected.

Figure 20B:
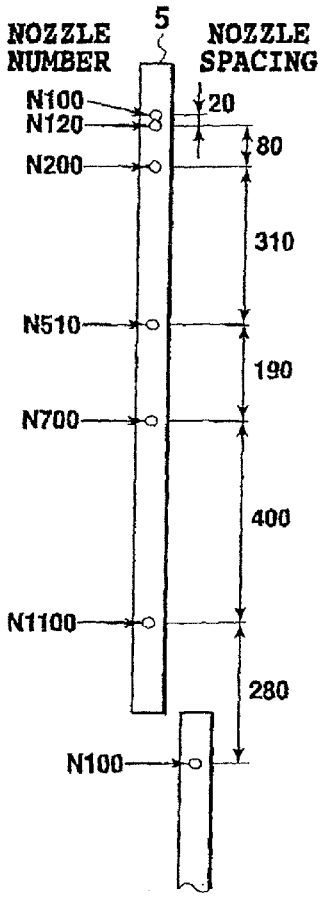
FIG. 20B is a diagram showing the results of correction of the nozzle N500 in FIG. 20A.

Then, after the nozzle to be corrected has been selected, the nozzle spacings between the remaining non-ejection nozzles unselected are recalculated. In the present example, calculations are executed except for the non-ejection nozzle having the nozzle number N500 selected. The results are as shown in FIG. 20B.

Then, as previously described, combinations of non-ejection nozzles with a nozzle spacing set value of no more than 30 are searched for on the nozzle spacings calculated. The combination with a nozzle spacing set value of no more than 30 is a set of the nozzle numbers N100 and N120. Then, a nozzle to be corrected is selected from this combination. In this case, the smaller nozzle number, that is, the nozzle number N100 is selected as a nozzle to be corrected.

Figure 20C:
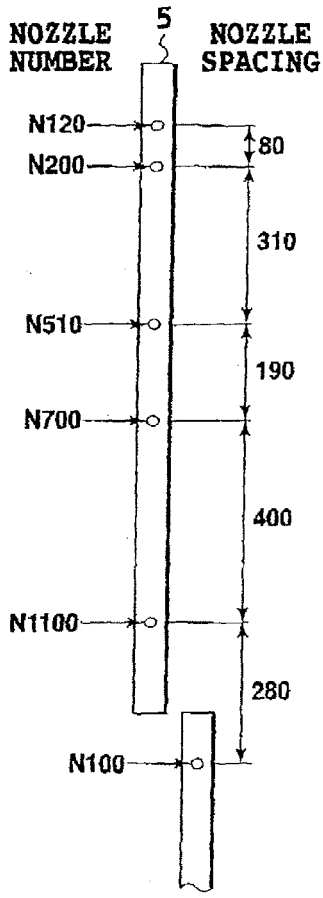
FIG. 20*c* is a diagram showing the results of correction of a nozzle N100 in FIG. 20B.

Then, as previously described, the nozzle spacings between the non-ejection nozzles unselected are recalculated and combinations of non-ejection nozzles with a nozzle spacing set value of no more than 30 are searched for. In this case, as shown in FIG. 20*c*, there is no combination of non-ejection nozzles with a nozzle spacing set value of no more than 30.

As described above, after the one nozzle to be corrected has been selected, the nozzle spacings between the non-ejection nozzles other than the one selected are calculated. Thus, nozzles to be corrected are sequentially selected.

As described above, the nozzle with the smaller nozzle numbers is selected from the combination with a nozzle spacing set value of at least 30. However, one of the non-ejection nozzles which has the larger nozzle number may be selected.

Alternatively, a nozzle to be corrected may be selected on the basis of positional relationship with surrounding nozzles. For example, for a combination of the nozzle numbers N500 and N510, the nozzle spacing (300) between the nozzle number N500 and the nozzle number N200, constituting another combination, may be compared with the nozzle spacing (190) between the nozzle number N510 and the nozzle number N700, constituting another combination. Then, the nozzle number N510, involving the smaller spacing, may be selected. That is, a nozzle to be corrected may be selected on the basis of the positional information on the surrounding nozzles.

THIRD EMBODIMENT

The nozzle spacing set value need not be fixed. The corrective printing can be more effectively carried out by allowing the nozzle spacing set value to be varied depending on the types of print media or inks. In the present embodiment, description will be given of a method for varying the nozzle spacing set value depending on the types of print media.

The appearance of white lines caused by non-ejection nozzles depend heavily on the types of print media. For example, on print media on which impacting ink droplets are likely to spread, that is, to bleed, ink impacting pixels surrounding a dot missing pixel bleeds and spreads to the dot missing pixel. As a result, the area of the missing part is reduced to make the white line visually unnoticeable. On the other hand, on print medium on which ink droplets are unlikely to bleed, the impacting ink droplets do not widely spread, thus making clear the stripe part, from which dots are missing. Further, the appearance of white lines depends on print colors, glossiness, or the like.

In the first and second embodiments, when non-ejection nozzles are selected, a combination of non-ejection nozzles with a nozzle spacing of no more than a predetermined value is calculated, with one of these non-ejection nozzles selected as a correction target, regardless of the types of print media.

In the present embodiment, the value of the nozzle spacing, used to calculate combinations of non-ejection nozzles, is varied depending on the types of print media.

FIG. 21 shows the relationship between six types of print media (hereinafter referred to as "media") A (ordinary paper), B (coated paper), C (glossy paper), D (OHP), E (postcard), and F (post card for use ink jet printing, hereinafter referred to as "ink jet postcard") and the nozzle spacing used for the calculation.

In Table 1, for the media A (ordinary paper), the nozzle spacing set value is 30. A combination of non-ejection nozzles with a nozzle spacing of no more than 30 is calculated on the basis of positional information on non-ejection nozzles. One of the non-ejection nozzles in the combination is selected as a correction target.

White lines on the media B (coated paper) are slightly more noticeable than those on the ordinary paper. Accordingly, the nozzle spacing set value is set at 45 for the media B. Then, a combination of non-ejection nozzles with a nozzle spacing of no more than 45 is calculated on the basis of positional information on non-ejection nozzles. One of the non-ejection nozzles in the combination is selected as a correction target.

White lines on the media C (glossy paper) are much more noticeable than those on the ordinary paper. Accordingly, the nozzle spacing set value is set at 50 for the media C. White lines are unnoticeable on the media D (OHP sheet). Accordingly, the nozzle spacing set value is set at 20 for the media D. In this manner, the larger the nozzle spacing set value is, the higher the possibility that a non-ejection nozzle to be corrected is selected.

By varying the nozzle spacing set value for each media type to select a non-ejection nozzle, it is possible to always appropriately select a non-ejection nozzle to be corrected in spite of the use of difference media.

FOURTH EMBODIMENT

In the description of the third embodiment, the conspicuity of white lines varies depending on the types of print media to be printed. The conspicuity of white lines also varies depending on the types of inks. For example, white strips corresponding to a missing ink in a solid image in yellow, which has a relatively high lightness, are unnoticeable owing to surrounding yellow dots. On the other hand, white strips corresponding to a missing ink in a solid image in cyan are noticeable because of a high contrast between surrounding cyan dots and the image missing part compared to the case of yellow.

Further, the likelihood of ink bleeding varies depending on the types of inks. Accordingly, even on the same print media, white lines are more unnoticeable with an ink likely to bleed than with an ink unlikely to bleed. In contrast, white lines appear clearer with an ink likely to bleed.

Furthermore, even with the same color ink, the conspicuity of white lines varies depending on the density of the ink. If two inks of the same color but different densities are used for printing under the same conditions, white lines are more noticeable with the darker color ink.

For example, for a certain kind of ink, white lines cannot be perceived in the image provided that the non-ejection nozzles are separate from each other by a distance corresponding to about 30 nozzles. However, if another kind of ink is used for printing, white lines can be perceived even though the non-ejection nozzles are separate from each other by a distance corresponding to about 30 nozzles, and the image is unacceptable. Thus, to deal with the degree of white lines varying with the types of inks, the present embodiment varies the nozzle spacing value, used to calculate combinations of non-ejection nozzles.

FIG. 22 is a table showing nozzle spacing set values for four types of inks, that is, the black, cyan, magenta, yellow inks. Of the four colors, the black results in the most noticeable white lines. Accordingly, the nozzle spacing is set at the largest value, 50. Of the four colors, the yellow results in the most unnoticeable white lines. Accordingly, the nozzle spacing is set at the smallest value, 10.

For example, for the cyan ink, a combination of non-ejection nozzles with a nozzle spacing of no more than 30 nozzles is searched for among the non-ejection nozzles in the cyan nozzle row. One of the non-ejection nozzles in the combination is then selected as a correction target. For the magenta ink, a combination of non-ejection nozzles with a nozzle spacing of no more than 25 nozzles is searched for among the non-ejection nozzles in the magenta nozzle row. One of the non-ejection nozzles in the combination which has the smaller nozzle number is then selected as a correction target.

By thus varying the nozzle spacing set value depending on the types of inks to select a nozzle to be corrected for each ink, it is possible to select the optimum nozzle to be corrected in accordance with the types of inks.

In the present embodiment, the nozzle interval set value is varied depending on the types of inks. However, this may be combined with the third embodiment for the print media. That is, the nozzle spacing set value may be varied depending on a combination of the media type and the ink type. For example, the nozzle spacing set value is set at 30 for ordinary paper and the cyan ink and at 50 for glossy paper and the cyan ink.

FIFTH EMBODIMENT

In the present embodiment, description will be given of a method for selecting non-ejection nozzles to be corrected if the amount of ink droplets ejected varies depending on the structure of the print head and driving conditions for the print head. In this case, the basic flow of the selecting method is the same as that according to the first and second embodiments. Thus, description will be given of a variation in nozzle spacing set value dependent on the amount of ink ejected.

The appearance of white lines also depends on the amount of ink droplets ejected from the print head. With a large amount of ink droplets ejected, the area of pixels not printed as a result of non-ejection nozzles is large. Consequently, the white lines can be more clearly perceived. On the other hand, with a small amount of ink droplets ejected, small dots are formed and the area of the pixels not printed as a result of non-ejection nozzles is unnoticeable. Consequently, the white lines are more unnoticeable than in the case of a small amount of ink droplets ejected.

Accordingly, the present embodiment varies the nozzle spacing value, used to calculate combinations of non-ejection nozzles, depending on the amount of ink droplets ejected.

For example, as shown in FIG. 23, the nozzle spacing value is set at 50 for an ejection amount of 30 pl, at 30 for an ejection amount of 30, and at 20 for an ejection amount of 20. That is, the nozzle spacing value is set so that the number of non-ejection nozzles selected as correction targets increases consistently with the ejection amount. This set value is used to select nozzles to be corrected.

In the present embodiment, the nozzle spacing set value is varied depending on the ejection amount. However, the value may be varied depending on the combination of the ink type and the media type, shown in the third and fourth embodiments.

By thus varying the nozzle spacing set value depending on the ejection amount to select nozzles to be corrected, it is possible to select the optimum nozzles to be corrected.

SIXTH EMBODIMENT

In the present embodiment, description will be given of a method for selecting non-ejection nozzles to be corrected if a different number of passes are used. In this case, the basic flow of the selecting method is the same as that according to the first and second embodiments. Thus, description will be given of a variation in nozzle spacing set value dependent on the number of passes.

The appearance of white lines in the image resulting from non-ejection nozzles depend heavily on the number of passes for printing. For 1-pass printing, only one nozzle is used to print all the print data for a print area for one raster. Accordingly, if the ink cannot be ejected from this nozzle, the raster is totally unprinted. That is, dots are missing from all the pixels in the one raster. However, for multipass printing, one raster is printed using two nozzles for 2-pass printing and four nozzles for 4-pass printing. That is, the data is divided into pieces for the respective nozzles. Thus, even if one of the two nozzles printing the print area for one raster in the 2-pass printing is a non-ejection nozzle, half of the print data is printed. Consequently, the white lines are more unnoticeable than in the 1-pass printing. Further, for 4-pass printing, even if one of the four nozzles printing the print area for one raster is a non-ejection nozzle, three-fourths of the print data is printed. Consequently, the white lines are much more unnoticeable. In this manner, the white lines are more unnoticeable as the number of printing passes increases.

Accordingly, the present embodiment varies the nozzle spacing value, used to calculate combinations of non-ejection nozzles, depending on the number of printing passes.

For example, if the printing pass number varies as shown in FIG. 24, the nozzle spacing value is set at 50 for 1-pass printing, at 30 for 2-pass printing, and at 20 for 4-pass printing. This set value is used to select nozzles to be corrected.

In the present embodiment, the nozzle spacing set value is varied depending on the printing pass number. However, the nozzle spacing set value may be varied depending on the combination of the ink type, media type, and ejection amount, shown in the third and fourth embodiments.

By thus varying the nozzle spacing set value depending on the printing pass number to select nozzles to be corrected, it is possible to select the optimum nozzles to be corrected.

SEVENTH EMBODIMENT

In the present embodiment, the nozzle spacing set value is varied depending on print modes. A detailed description will also be given of the acquisition of positional information on defective nozzles, the selection of nozzles to be corrected based on the positional information acquired, and operations performed by the printing apparatus to execute a correcting process on print data output by the host to complete printing.

In the present embodiment, a personal computer (hereinafter also simply referred to as a PC) that is the host apparatus connected to the printing apparatus is assumed to execute a process of converting data on an image to be printed by the printing apparatus (hereinafter referred to as image data) into print data corresponding to the printing apparatus.

A process of correcting print data for nozzles to be corrected is executed on print data received by the printing apparatus from the host apparatus. The printing apparatus carries out printing on the basis of the print data subjected to the correcting process.

Figure 26:
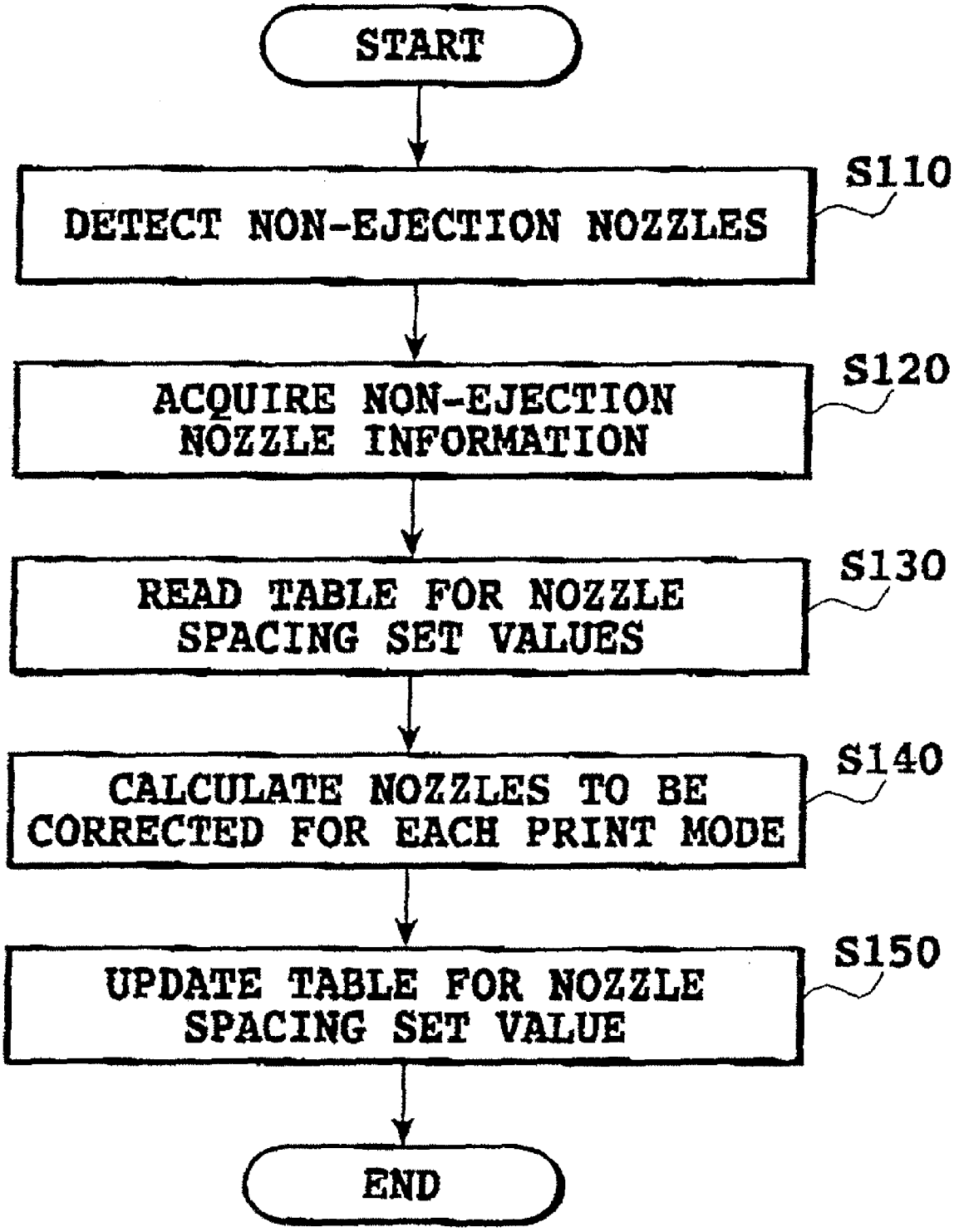
FIG. 26 is a flowchart showing a method for selecting nozzles to be corrected.

FIG. 26 is a flowchart showing a method for selecting nozzles to be corrected according to the present embodiment.

First, at step S110, non-ejection nozzles are detected in order to acquire positional information on defective nozzles in the print head 5. The non-ejection nozzles may be detected by using non-ejection sensing means provided in the printing apparatus or using a method in which the user checks a predetermined pattern printed on a print medium to indicate non-ejection nozzles to the printing apparatus. The non-ejection sensing means in the printing apparatus may be an optical sensor; ink droplets are ejected so as to block the optical axis of the optical sensor so that it is determined whether or not ink droplets have been ejected, on the basis of an output value from the optical sensor.

With another method, a temperature detecting element is provided. Ink droplets are then ejected to the temperature detecting element. It is then determined whether or not ink droplets have been ejected, on the basis of an output value from the temperature detecting element. With another method, a predetermined pattern is printed on a print medium used to detect non-ejection nozzles. A CCD or a photo sensor is then used to read the pattern printed. It is then determined whether or not the ink has been ejected from the respective nozzles. If no means for detecting non-ejection nozzles is provided in the printing apparatus and the user specifies non-ejection nozzles on the basis of a pattern printed, the user inputs information on the non-ejection nozzles using a user interface (hereinafter simply referred to as a UI) screen of a printer driver in the PC or a control panel (input means) provided in the printing apparatus.

Then, in step S120, the printing apparatus acquires positional information on the non-ejection nozzles detected in step S110.

Then, in step S130, data of the nozzle spacing set values stored in the memory in the printing apparatus are read. The nozzle spacing set values are stored in the memory as data of a table in which the nozzle spacing set values are preset for the respective print modes as shown in FIG. 27. The nozzle spacing set values need not necessarily be stored in the memory as a table but may be stored in the memory as a plurality of thresholds data that associate nozzle spacing set values with the respective print modes. Corrective processing and complementary printing are carried out so as to print all nozzle print data corresponding to the nozzle spacing set values. Consequently, the print grade increases consistently with the nozzle spacing set value. Further, print modes may be set taking both print media type and print grade mode into account.

Then, in step S140, nozzles to be corrected in each print mode are determined on the basis of the positional information on the non-ejection nozzles acquired in step S120 and the nozzle spacing set values acquired in step S130. For example, in the print mode A, the nozzle spacing set value is 30 nozzles as shown in FIG. 27. Accordingly, when the spacing between non-ejection nozzles is no more than 30 nozzles, one of the non-ejection nozzles is selected as a correction target so as to increase the spacing between the non-ejection nozzles above 30 nozzles. Likewise, for the other print modes, nozzles to be corrected are determined on the basis of the respective non-ejection nozzle spacing set values.

Then, in step S150, data of a table stored in the memory in the printing apparatus and showing nozzles to be corrected is updated to finish the process of selecting nozzles to be corrected. On this occasion, data of a table in which each print mode is associated with nozzles to be corrected as shown in FIG. 28 is stored in the memory.

The process of selecting nozzles to be corrected may be executed using an arbitrary timing, for example, for every page printing, for every print job, for every print head recovering operation, or when the number of dots printed exceeds a predetermined value.

Figure 29:
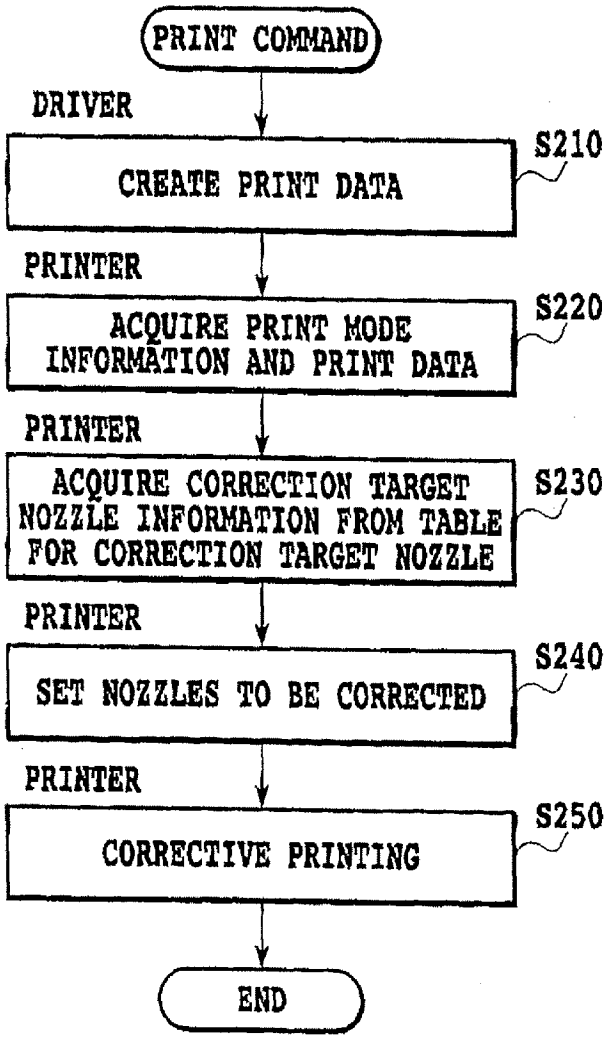
FIG. 29 is a flowchart showing a method for carrying out complementary printing.

FIG. 29 is a flowchart of the processing procedure of printing from the reception of a print command until the end of printing.

First, the user selects, on the UI of the host computer, the type of print media to be printed and the grade of a print image. The user then pushes (selects) a print start button to issue a print command to the printing apparatus. At this time, the printer driver determines a print mode in which printing is to be carried out, on the basis of the type of print media and the grade of the print image selected by the user. In the present embodiment, when the type of print media and the grade of the print image are selected to be ordinary paper and standard, respectively, the print mode is determined to be the print mode A. When a print command is issued, the printer driver or an application on the host computer converts, in step S210, converts 8-bit image data on each of the R, G, and B into 1-bit data on each of the C, M, Y, and K to generate print data.

Then, in step S220, the printing apparatus acquires information on the print mode and print data from the host computer via the interface. Subsequently, in step S230, with reference to the to-be-corrected nozzle table updated in step S150 in FIG. 26, the information on nozzles to be corrected which corresponds to the print mode acquired in step S240 is read. In step S240, the nozzles to be corrected are set. For example, when the print mode acquired from the host computer is the print mode A, the nozzles having nozzle numbers N100, N150, N320, and N400 are set as nozzles to be corrected (see FIG. 28).

Then, in step S250, a correcting process is executed on data corresponding to the nozzles to be corrected which are set in step S240. The data corresponding to the nozzles to be corrected is printed in a complementary manner using adjacent normal nozzles. Non-ejection nozzles not set as correction targets are not subjected to complementary printing in which the print data corresponding to these non-ejection nozzles is made up for. By masking raster data corresponding to the non-ejection nozzles not set as correction targets to set it as null data, it is possible to prevent the destruction of the heaters in the nozzles and an increase in the temperature of the print head.

In this manner, the present embodiment executes complementary printing only on those of the non-ejection nozzles which significantly reduces the image grade. This makes it possible both to improve the image grade and to suppress a decrease in the lifetimes of the nozzles.

In the present embodiment, the printing apparatus selects nozzles to be corrected. However, the host computer connected to the printing apparatus may select nozzles to be corrected. The host computer may then assign data corresponding to the nozzles to be corrected to nozzles to be used for complementary printing (adjacent nozzles) before transmitting print data to the printing apparatus. Such a configuration reduces the amount of processing executed in the printing apparatus as well as the time required for processing from the reception to printing of print data. Moreover, no high-performance CPU needs to be provided in the printing apparatus, thus reducing the cost of the printing apparatus.

Further, in the present embodiment, the host computer connected to the printing apparatus executes image processing that converts 8-bit image data on the R, G, and B into 1-bit print data on the C, M, Y, and K. However, the printing apparatus may execute the image processing. When the printing apparatus executes the image processing, printing can be carried out without using any PC from a device such as a digital camera which has no programs for image processing.

As described above, according to the seventh embodiment, when there are a plurality of non-ejection nozzles, complementary printing is not executed on all the non-ejection nozzles. However, non-ejection nozzles to be corrected are selected on the basis of the positional relationship between the non-ejection nozzles in the print head. The complementary printing is then executed only on the non-ejection nozzles selected. This enables high-quality images to be printed while minimizing the loss of durability of the printhead. Further, defective nozzles to be corrected are selected for each print mode and stored in advance. Consequently, the optimum nozzles to be corrected can always be set without depending on the print mode used.

A plurality of nozzle spacing set values, used to select defective nozzles to be corrected, may be provided depending on the colors or types of inks. Specifically, different nozzle spacing set values corresponding to the ink colors are provided so that a larger nozzle spacing set value is used for an ink with which non-ejection nozzles result in noticeable white lines in the image, while a smaller nozzle spacing set value is used for an ink with which non-ejection nozzles result in unnoticeable white lines in the image. This enables high-quality images to be printed while minimizing the loss of durability of the print head.

EIGHTH EMBODIMENT

In the seventh embodiment, nozzles to be corrected are selected for each print mode and stored in the memory in advance. The nozzles to be corrected are read from the memory upon the reception of a print command. However, in the present embodiment, after a print command has been received, nozzles to be corrected are selected and printing is then carried out. The remaining part of the configuration is similar to that of the seventh embodiment, so that its description is omitted.

The eighth embodiment will be described below, in which after a print command has been received, nozzles to be corrected are selected and printing is then carried out.

Figure 30:
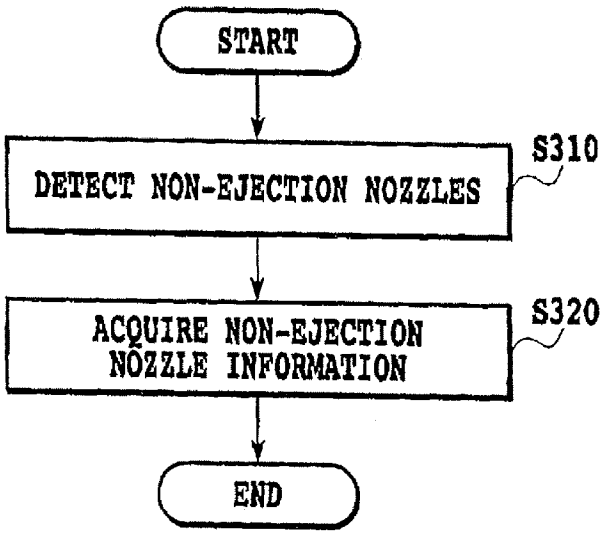
FIG. 30 is a flowchart showing how to acquire information on a nozzle to be corrected.

FIG. 30 is a flowchart showing the processing procedure of detecting non-ejection nozzles.

First, in step S310, non-ejection nozzles are detected in the print head 5 in order to acquire positional information on defective nozzles. A method similar to that of the second embodiment is used to detect non-ejection nozzles. Subsequently, in step S320, the printing acquires the positional information on the non-ejection nozzles detected in step S310. The processing is then finished.

In the seventh embodiment, non-ejection nozzles to be corrected are selected (calculated) after non-ejection nozzle information has been acquired. However, the process of detecting non-ejection nozzles according to the present embodiment is finished by acquiring positional information. This process may be executed using an arbitrary timing, for example, for every page printing, for every print job, for every print head recovering operation, or when the number of dots printed exceeds a predetermined value.

Figure 31:
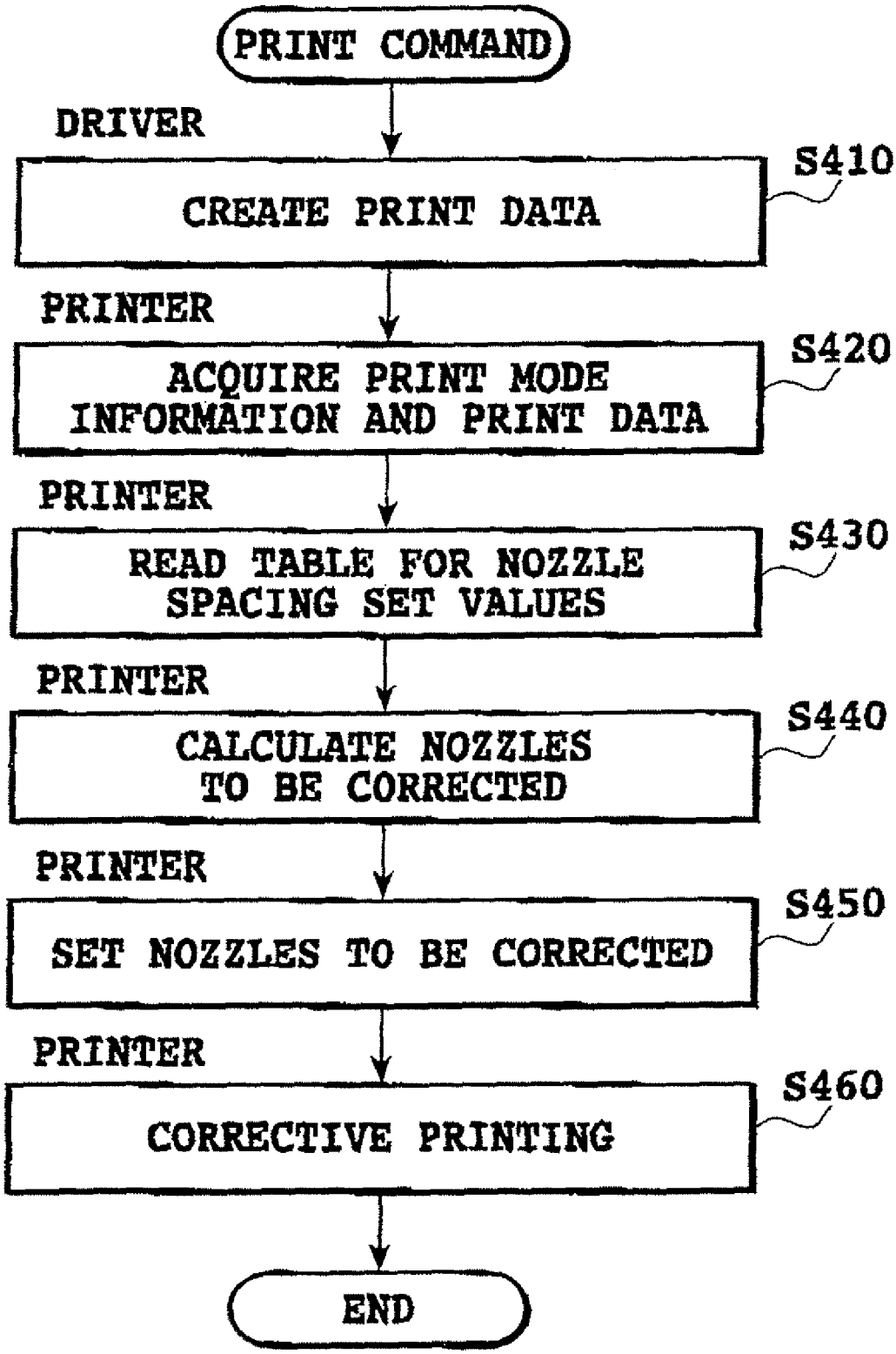
FIG. 31 is a flowchart showing a method of carrying out complementary printing.

FIG. 31 is a flowchart showing the processing procedure of printing from the reception of a print command until the end of printing.

The user issues a print command. In step S410, the printer driver or application on the host computer converts image data into print data.

Then, in step S420, the printing apparatus acquires information on the print modes and print data from the host computer via the interface. In step S430, the nozzle spacing set values stored in the memory in the printing apparatus are read. Then, in step S440, nozzles to be corrected during printing are selected on the basis of the positional information on the non-ejection nozzles acquired in step S320 in FIG. 30, the print modes acquired in step S420, and the nozzle spacing set values acquired in step S430. Subsequently, in step S450, the nozzles selected in step S430 are set as nozzles to be corrected.

Then, in step S460, a correcting process is executed on data corresponding to the nozzles to be corrected set in step S450.

Thus, the data corresponding to the nozzles to be corrected is made up for using adjacent normal nozzles. Further, the complementary printing is not executed on data corresponding to non-ejection nozzles not set as correction targets. By masking raster data corresponding to the non-ejection nozzles not set as correction targets to set it as null data, it is possible to prevent the destruction of the heaters in the nozzles and an increase in the temperature of the print head.

Thus, in the present embodiment, the complementary printing is executed only on the non-ejection nozzles that may severely degrade the image grade. It is therefore possible both to improve the image grade and to suppress a decrease in the lifetimes of the nozzles.

As described above, according to the eighth embodiment, during printing, nozzles to be corrected and subjected to complementary printing are selected from a plurality of non-ejection nozzles. The complementary printing is then executed only on the non-ejection nozzles selected. This enables high-quality images to be printed while minimizing the loss of durability of the print head. Further, since the nozzles to be corrected are selected during printing, it is unnecessary to provide a memory capacity for the storage of the nozzles to be corrected for each print mode. Moreover, since the nozzles to be corrected are selected for each print command, the optimum nozzles to be corrected can be selected during printing.

NINTH EMBODIMENT

In the seventh and eighth embodiment, nozzles to be corrected are selected on the basis of the nozzle spacing set value for each preset print mode. Thus, when there are different print media A and B classified into the same type (for example, ordinary paper A and ordinary paper B from different manufacturers), the same print mode is used for printing and the print medium A may be determined to provide a sufficient image quality, whereas the print medium B may be determined to provide an insufficient image quality.

Further, some users may be unsatisfied with a preset image quality or the preset image quality may be lower than that desired for the image to be printed. It is assumed that the user may desire to improve the image quality even through this leads to a slight decrease in the lifetimes of the nozzles or to give priority to the extension of lifetimes of the nozzles even though this leads to the degradation of the preset image quality.

Thus, according to the ninth embodiment, the user can arbitrarily change a correction level on the UI. The printing apparatus is configured in the same manner as in the seventh and eighth embodiments, so that its description is omitted.

FIGS. 33A-33E is a group of tables showing set values for the nozzle spacing corresponding to correction levels.

As shown in FIGS. 33A-33E, for each correction level, the nozzle spacing set value is set for each print mode. The correction level 3 shown in FIG. 33C is a reference set value and provides an image quality at a standard level. The nozzle spacings for the correction level 2 shown in FIG. 33B are smaller than those in the table for the correction level 3. At the correction level 2, a smaller number of defective nozzles are selected as correction targets. In other words, the correction level 2 is used if an image quality slightly lower than the standard level at the correction level 3 is tolerable. At the correction level 1 shown in FIG. 33A, all the nozzle spacing set values are set at zero. In this case, no nozzles to be corrected are selected regardless of the positional relationship among non-ejection nozzles. Further, the nozzle spacings in the table for the correction level 4 shown in FIG. 33D are larger than those in the table for the correction level 3. At the correction level 4, a larger number of defective nozzles are selected as correction targets. In other words, the correction level 4 is used if an image of an image quality higher than that obtained at the standard level at the correction level 3. Moreover, at the correction level 5 shown in FIG. 33E, the nozzle spacings are set at a value equal to the total number of nozzles in the print head 5 per color. In this case, all the defective nozzles are always selected as correction targets regardless of the positional relationship among the non-ejection nozzles.

Now, description will be given of the present embodiment, in which the user can change the image quality to a desired level on the basis of the number of non-ejection nozzles to be corrected.

Figure 32:
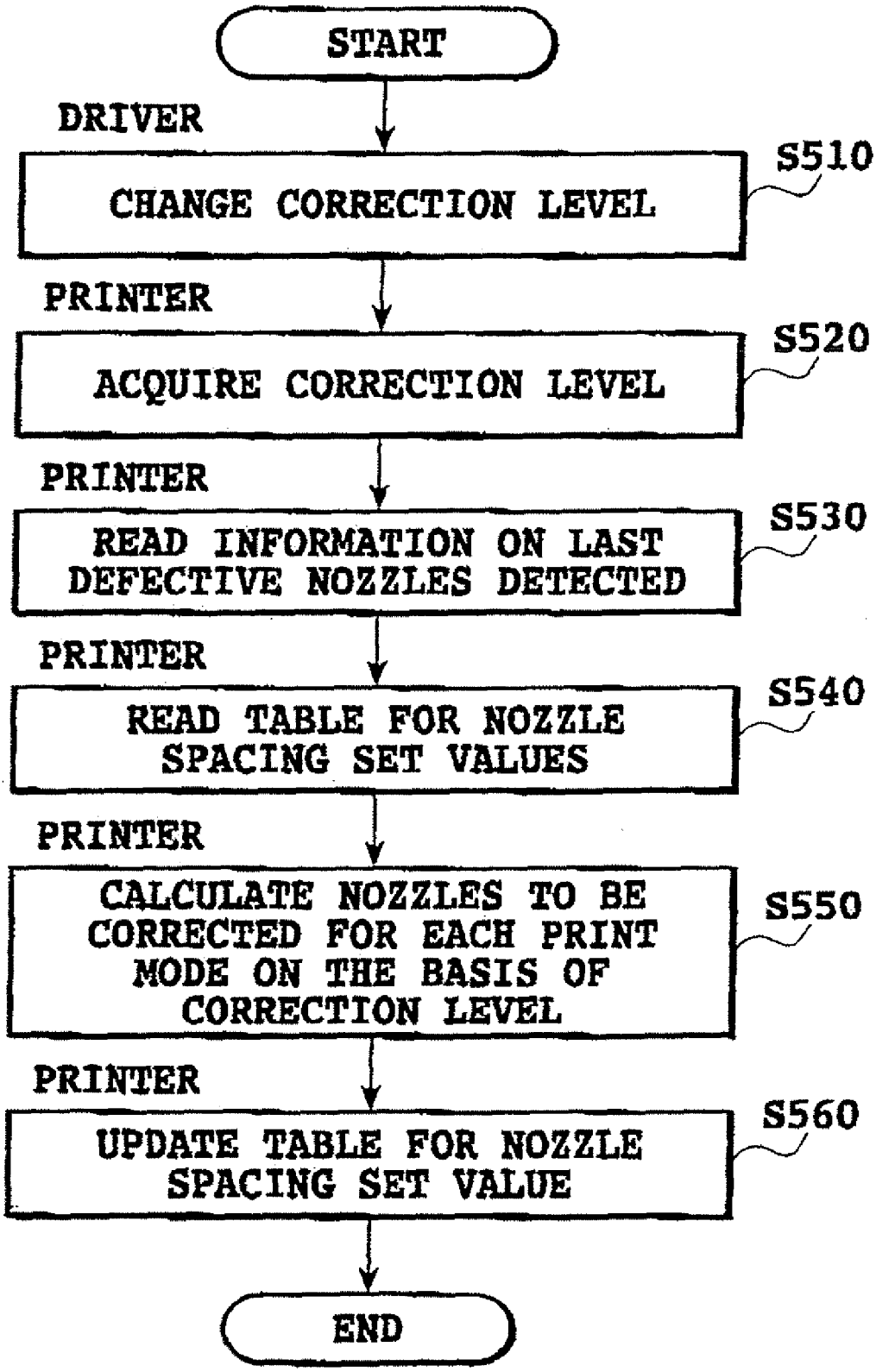
FIG. 32 is a flowchart showing a method of carrying out complementary printing.

FIG. 32 is a flowchart illustrating the processing procedure of reselecting defective nozzles to be corrected in response to a change in correction level made by the user.

First, in step S510, the user selects (changes) a correction level on the UI of the host computer. The correction level ranges from 1 (low image quality) to 5 (high image quality). The user can arbitrarily set the correction level.

Then, in step S520, the printing apparatus acquires information on the correction level selected from the printer driver. Then, in step S530, information on the last non-ejection nozzle detected is read from the memory in the printing apparatus. Then, in step S540, one of the nozzle spacing set value tables stored in the memory in the printing apparatus is read. The nozzle spacing set value tables describe nozzle spacing set values preset for each correction level as shown in FIGS. 33A-33E. Thus, data of the table corresponding to the correction level acquired in step S520 is read.

Then, in step S550, nozzles to be corrected are selected for each print mode on the basis of the positional information on the non-ejection nozzles and the nozzle spacing set value table corresponding to the correction level. Finally, in step S560, data of the correction target nozzle table stored in the memory in the printing apparatus is updated. The procedure is then finished.

The present embodiment updates the correction target nozzle table when the correction level is changed. The printing process in the present embodiment is similar to that in the seventh embodiment, so that its description is omitted.

In this manner, the configuration of the present embodiment enables the optimum complementary printing to be achieved in accordance with the nature of print medium or the user's purpose.

Further, in the present embodiment, nozzles to be corrected are recalculated when the correction level is changed. However, nozzles to be corrected may be pre-calculated for each correction level so that upon the reception of a print command, information on the correction level and print mode is acquired to switch the nozzles to be corrected.

Alternatively, nozzles to be corrected may be calculated for every printing operation in accordance with the print mode and correction level.

By using the methods of selecting non-ejection nozzles to be corrected as described in the first to eighth embodiments and a combination of these methods, it is possible to appropriately select only those of a plurality of non-ejection nozzles which correspond to relatively noticeable dot missing parts on the print image. Consequently, the complementary printing is executed only on non-ejection nozzles leading to noticeable dot missing parts. Therefore, complementary printing can be efficiently carried out. Further, the lifetimes of normal nozzles are prevented from being wastefully reduced.

That is, if there are a plurality of nozzles from which ink cannot be ejected, not all these non-ejection nozzles are corrected. However, non-ejection nozzles to be corrected are selected on the basis of the positional relationship among the non-ejection nozzles in the print head. The non-ejection nozzles selected are then corrected. This enables high-quality images to be printed while minimizing the loss of durability of the print head.

OTHER EMBODIMENTS

The present invention is applicable to a system composed of a plurality of apparatuses (for example, a host computer, an interface apparatus, a reader, and a printer) or a single apparatus (for example, a copier or a facsimile machine).

The following is also included in the scope of the present invention. Program codes in software required to realize the functions shown in the above embodiments are supplied to a computer in an apparatus or computer which is connected to various devices, so as to operate these devices to realize the functions. The computer (CPU or MPU) in the system or apparatus then operates the devices in accordance with the program stored.

In this case, the program codes of the software realize the above embodiments. The present invention is thus composed of the program codes themselves and means for supplying the program codes to the computer, for example, a storage medium storing the program codes.

The storage medium storing the program codes may be a floppy (registered trade mark) disk, a hard disk, an optical disk, a magneto optic disk, a CD-ROM, a magnetic tape, a nonvolatile memory card, a ROM, or the like.

As described above, the functions of the above embodiments are realized by the computer by executing the program codes supplied. However, if the program codes cooperate with an OS (Operating System) running in the computer, another application software, or the like in realizing the functions of the above embodiments, the program codes are also included in the embodiments of the present invention.

Of course, the following case is also included in the present invention. The program codes supplied are stored in a memory provided in an expansion board of the computer or an expansion unit connected to the computer. Then, on the basis of instructions in the program codes, for example, a CPU provided in the expansion board or unit executes a part or all of actual processing. The processing thus realizes the functions of the above embodiments.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application Nos. 2003-411058 filed Dec. 9, 2003 and 2003-424984 filed Dec. 22, 2003, which are hereby incorporated by reference herein.

What is claimed is:

1. A printing method for a printing apparatus that uses a print head having a plurality of print elements to print on a print medium, said printing method comprising the steps of:

acquiring positional information on non-ejection print elements in which ink ejection is abnormal;

selecting non-ejection print elements as correction targets on the basis of the positional information on the non-ejection print elements acquired in said positional information acquiring step; and complementary printing on print areas of the print medium corresponding to the non-ejection print elements selected in said selecting step as correction targets, using other normal print elements, wherein said selecting step includes calculating a distance between the non-ejection print elements, comparing the calculated distance between the non-ejection print elements with a preset value, and selecting, as one of the correction targets, one of the non-ejection print elements in a combination for which has been determined that the distance between the non-ejection print elements is no more than the preset value.

2. A printing method according to claim 1, wherein the positional information on the non-ejection print elements selected in said selecting step as the correction targets is stored in a memory in the printing apparatus.

3. A printing method according to claim 1, further comprising the step of changing the preset value, wherein said selecting step comprises selecting the non-ejection print elements to be corrected on the basis of the preset value changed in said changing step.

4. A printing method according to claim 1, wherein said complementary printing step performs complementary printing by adding print data for the print areas corresponding to the non-ejection print elements to print data of another normal print element printing on the print areas corresponding to the non-ejection print elements when more than one print element in the same print head prints on the same print area.

5. A printing method according to claim 1, wherein the preset value is varied depending on a print mode.

6. A printing method according to claim 5, wherein the positional information on the non-ejection print elements selected in said selecting step as the correction targets is stored in a memory in the printing apparatus.

7. A printing method according to claim 1, wherein said positional information acquiring step comprises printing a predetermined pattern on the basis of which positions of the non-ejection print elements in the print head can be identified, and determining the non-ejection print elements on the basis of the printed predetermined pattern, thereby acquiring the positional information on the non-ejection print elements.

8. A printing method according to claim 7, wherein the positional information on the non-ejection print elements selected in said selecting step as the correction targets is stored in a memory in the printing apparatus.

* * * * *